US005352651A

United States Patent [19]

Debe et al.

[11] Patent Number: 5,352,651

[45] Date of Patent: Oct. 4, 1994

[54] NANOSTRUCTURED IMAGING TRANSFER ELEMENT

[75] Inventors: Mark K. Debe, Stillwater, Minn.; Kam K. Kam, Woodbury, Md.; Richard J. Poirier, White Bear Lake, Minn.

[73] Assignee: Minnesota Mining and Manufacturing Company, St. Paul, Minn.

[21] Appl. No.: 996,124

[22] Filed: Dec. 23, 1992

[51] Int. Cl.[5] ..... B41M 5/035; B41M 5/38

[52] U.S. Cl. ..... 503/227; 427/146; 427/152; 428/195; 428/321.3; 428/910; 428/913; 428/914

[58] Field of Search ..... 8/471; 428/195, 321.3, 428/913, 914, 910; 503/227; 427/146, 152

[56] References Cited

U.S. PATENT DOCUMENTS

| | | | |
|---|---|---|---|
| 4,148,294 | 4/1979 | Scherber et al. | 126/270 |
| 4,155,781 | 5/1979 | Diepers | 148/175 |
| 4,209,008 | 6/1980 | Lemkey et al. | 126/452 |
| 4,245,003 | 1/1981 | Oransky et al. | 428/323 |
| 4,252,864 | 2/1981 | Coldren | 428/571 |
| 4,396,643 | 8/1983 | Kuehn et al. | 427/160 |
| 4,491,432 | 1/1985 | Aviram et al. | 400/241.1 |
| 4,494,865 | 1/1985 | Andrus et al. | 355/32 |
| 4,541,830 | 9/1985 | Hotta et al. | 8/471 |
| 4,549,824 | 10/1985 | Sachdev et al. | 400/241.1 |
| 4,772,582 | 9/1988 | DeBoer | 503/227 |
| 4,788,128 | 11/1988 | Barlow | 430/200 |
| 4,804,975 | 2/1989 | Yip | 346/76 L |
| 4,804,977 | 2/1989 | Long | 346/76 L |
| 4,812,352 | 3/1989 | Debe | 428/142 |
| 4,876,235 | 10/1989 | DeBoer | 503/227 |
| 4,904,572 | 2/1990 | Dombrowski, Jr. et al. | 430/332 |
| 4,962,081 | 10/1990 | Harrison et al. | 503/227 |
| 4,965,242 | 10/1990 | DeBoer et al. | 503/227 |
| 4,969,545 | 11/1990 | Hayashi | 192/0.076 |
| 4,975,410 | 12/1990 | Weber et al. | 503/227 |
| 4,977,134 | 12/1990 | Jongewaard et al. | 503/227 |
| 4,978,652 | 12/1990 | Simons | 503/227 |
| 4,978,974 | 12/1990 | Etzel | 346/107 R |
| 4,988,664 | 1/1991 | Smith et al. | 503/227 |
| 5,017,547 | 5/1991 | DeBoer | 503/227 |
| 5,039,561 | 8/1991 | Debe | 427/255.6 |
| 5,238,729 | 8/1993 | Debe | 428/245 |

FOREIGN PATENT DOCUMENTS

| | | | |
|---|---|---|---|
| 0452498A1 | 10/1991 | European Pat. Off. | 503/227 |
| 4110175A1 | 10/1991 | Fed. Rep. of Germany | 428/321.3 |
| 61-242872 | 10/1986 | Japan | 503/226 |
| 1-103489 | 4/1989 | Japan | 428/913 |
| 2-3387 | 1/1990 | Japan | 428/321.3 |
| 3-114783 | 5/1991 | Japan | 428/321.3 |
| 3-205191 | 9/1991 | Japan | 428/321.3 |
| 3-216382 | 9/1991 | Japan | 428/488.1 |
| WO88/04237 | 6/1988 | PCT Int'l Appl. | 428/321.3 |
| 2083726A | 3/1982 | United Kingdom | 503/227 |

OTHER PUBLICATIONS

J. Vac. Sci. Technol. A 1(3), Jul.-Sep. 1983, pp. 1398-1402 "Ion-bombardment-induced whisker formation on graphite".

Morrison & Boyd, Organic Chemistry, 3rd ed., Allyn & Bacon, Inc. (1974) Chapters 30 and 31.

*Primary Examiner*—B. Hamilton Hess

*Attorney, Agent, or Firm*—Gary L. Griswold; Walter N. Kirn; Carolyn V. Peters

[57] ABSTRACT

A reusable nanostructured donor medium is provided comprising an image forming material containing polymeric film having a nanostructured surface region, at at least one major surface of the film, such that the nanostructured surface region is bifunctional. This bifunctionality being an efficient radiation to heat conversion element, as well as serving as a capillary pump to replenish the nanostructured surface region with an image forming material after an imaging event has occurred.

20 Claims, 8 Drawing Sheets

NANOSTRUCTURED IMAGING TRANSFER ELEMENT

TECHNICAL FIELD

This invention relates to radiation transfer media, and more particularly to sublimation and/or diffusion transfer imaging media that is a reusable donor media for multiple imaging.

BACKGROUND OF THE INVENTION

In conventional dye transfer imaging, heat is applied imagewise to a donor sheet, that is, a dye containing layer coated onto a support. The dye sublimes and/or diffuses from the donor sheet to a receptor sheet to produce an image on the receptor sheet. Disadvantageously, art known donor elements are generally suitable only for single event dye transfer. Traditionally, the heat is applied to the donor sheet (1) by thermal conduction from heated styli, or (2) by absorption of light and internal conversion to heat by carbon or graphite particles or near-IR absorbing molecules present in the vicinity of the dye. When light to heat conversion elements are dispersed in the binder, the dispersion properties of the system must be accounted for.

Some art known transfer media use near infrared (IR) absorbing dyes or graphite/carbon/metal particles dispersed in the dye/binder layer or wholly separated from the dye layer as the light to heat absorbing elements. In those cases where the light absorbing elements are uniformly distributed in the dye/binder layer, radiation is absorbed throughout the dye layer. Since the entire layer is heated, some binder may also be transferred with the dye, especially if the dye-containing layer is thin. When carbon black is used as the absorbing element, carbon contamination can lead to desaturated colors.

SUMMARY OF THE INVENTION

Briefly, in one aspect of the present invention, a donor medium is provided comprising an image forming material-containing polymeric film, nominally 0.001" to 0.010" (25–250 μm) thick, having a nanostructured surface region, nominally ≦5 μm thick, on at least one major surface of the film. This nanostructured surface region is bifunctional. First, it serves as a light-to-heat conversion element (a "radiation absorber") in the donor medium. Second, it serves as a "capillary pump" to bring image forming materials from the reservoir of the rest of the donor medium into the nanostructured surface region thereby replenishing the image forming material in that surface region, which was transferred to a receptor sheet during a previous imaging pulse.

A receptor sheet (also referred to as "receptor") is placed against the nanostructured side of the donor medium. Light is incident from either side of the donor medium if the receptor is transparent, or from the donor medium side if the receptor is opaque. It has been observed the radiation absorbed by the nanostructured surface region of the donor medium results in transfer to the receptor of an image forming material. While not being bound by theory it is believed that capillarity function of the nanostructured layer may be a contributing factor to the feature of multiple use of the donor medium of the present invention.

"Nanostructured" as used in this application means the surface region contains a compositional inhomogeneity with a spatial scale on the order of tens of nanometers in at least one dimension giving it the radiation absorbing and capillarity properties described below. An example of such a nanostructured surface region with a spatial inhomogeneity in two dimensions is one comprised of elongated radiation absorbing particles (nanostructured elements) encapsulated exactly at the surface of the encapsulant with sufficient numbers per unit area to achieve the desired properties of efficient light absorption and high capillarity. A two-dimensional spatially inhomogenous nanostructured surface region can be one such that translating through the region along any two of three orthogonal directions, at least two different materials will be observed, for example, the nanostructured elements and a polymeric binder.

Advantageously, only the nanostructured elements of the present invention absorbs the radiation, acting as minute heating elements localized directly at the donor/receptor interface. Thus, the heat has only to diffuse a short distance between nanostructured elements to heat the image forming material in the vicinity of the nanostructured elements.

Further features of the nanostructured elements are the physical structure and orientation of the nanostructured surface region that endow the nanostructured surface region with capillary properties. While not be being bound by theory, it is believed these properties and high surface area facilitate replenishment of the image forming material to the depleted surface region after each imagewise transfer event to make a multiple use donor medium.

A particular advantage exists of using nanostructured elements for the donor medium comprising a uniform distribution of the elements fixed on a temporary substrate such that any art known image forming material/binder system can be coated onto them without regard to dispersion problems of the light-to-heat conversion element.

It is a further aspect of this invention that the imagewise transfer process inherently offers high spatial resolution. It is believed this characteristic is due to the thinness of the radiation absorbing layer, its location precisely at the surface, the small size of the elements and the absence of lateral light scattering outside the irradiated area.

It is a further aspect of this invention that the process for forming the optically absorbing, high capillarity nanostructured surface region of the image forming material/polymer composite layer be independent of the latter such that any system can be configured to have such a nanostructured surface.

BRIEF DESCRIPTION OF THE DRAWING(S)

DESCRIPTION OF THE PREFERRED EMBODIMENT(S)

Figure 1:
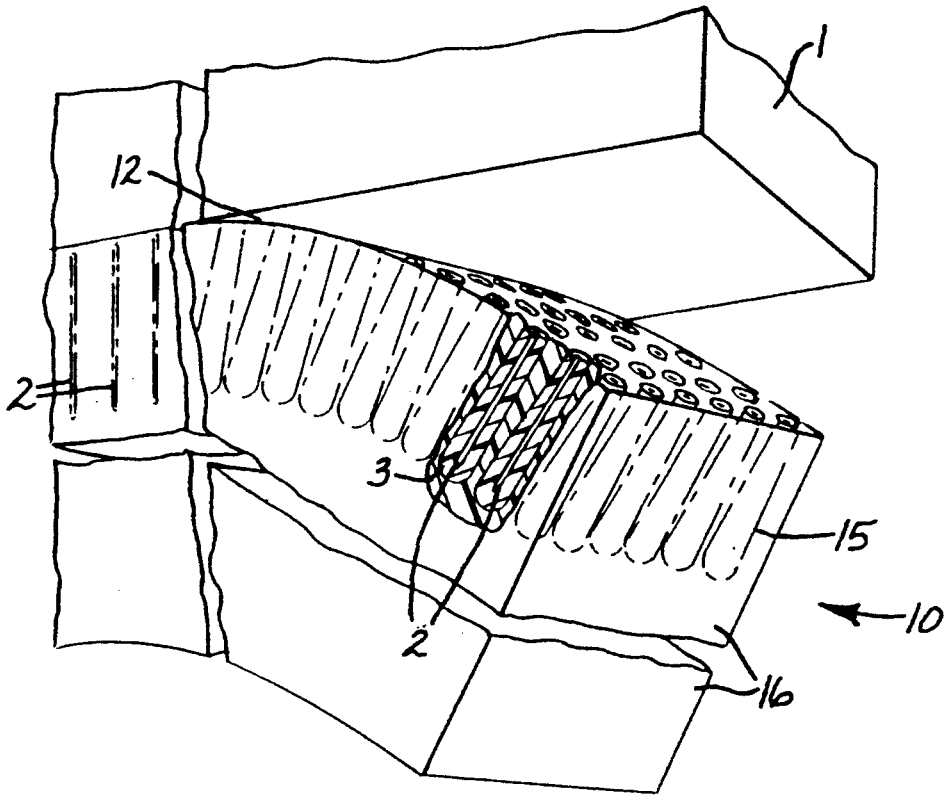
FIG. 1 is a perspective view of a donor sheet with a nanostructured composite surface being delaminated from a substrate.

The present invention comprises a composite donor medium having a nanostructured surface region on at least one major surface of the medium, within a polymer composite layer. The nanostructured surface region is nominally $\leqq 5$ μm thick and is bifunctional. An example of such a nanostructured surface region with a spatial inhomogeneity in two dimensions is one comprised of elongated radiation absorbing particles (nanostructure elements) encapsulated exactly at the surface of a polymeric binder with sufficient numbers per unit area to achieve the desired properties of efficient light absorption and high capillarity.

First, the nanostructured surface region serves as a light-to-heat conversion element necessary in radiation addressed thermal transfer donor media. Advantageously, light energy can be absorbed with high efficiency at all wavelengths by the nanostructured surface region. For example, over 98% absorption has been measured from 200 to 900 nanometers. Subsequent heating of the donor medium is localized in the vicinity of the nanostructured surface region. Any image forming material present in the nanostructured surface region sublimes and/or diffuses to an adjacent receptor sheet. As a result, broad band, large area illumination, or scanning laser radiation within a wide range of wavelengths can be used for imaging. Heating efficiency and spatial resolution are improved due to localization of the heating precisely at the surface of the donor medium.

A second unique function of the nanostructured surface region is to serve as a "capillary pump" to bring image forming molecules from the bulk of the binder composite layer (serving as a reservoir) into the nanostructured surface region. This pumping action replenishes the image forming material in the nanostructured surface region, which was depleted during a transfer to a receptor sheet during an imaging pulse.

While not intending to be bound by theory, it is believed several mechanisms combine to drive the image forming material from the bulk of the composite layer to replenish the heated (from the light pulse) volume of image forming material/binder situated in the interstices between the nanostructure elements. The shape, size, close packing and high surface area of the nanostructured elements of the preferred form are believed to have a high degree of capillarity and to endow the nanostructured surface region with such high capillarity as well. It has been observed that liquid encapsulants or encapsulants in a liquid-like state rapidly and completely wet the entire surface area of the nanostructured element without entrapment of air in the ~50 nm sized interstices between the nanostructured elements. It is useful to think of the interstices between the nanostructured elements as the capillaries. Since the small sizes, high aspect ratios, and dense packing (resulting from uniaxial orientation) of the nanostructured elements of the preferred kind all contribute to the large number of elements per unit area, the total surface free energy of the nanostructured surface region would be expected to be large.

When the nanostructured elements are encapsulated, the encapsulant (image forming material and the binder) that surrounds the nanostructured elements will equilibrate in a manner consistent with the principle known in the art of minimizing the total interfacial free energy of a system. For example, when heated with imaging radiation, causing the image forming material to melt or vaporize and flow out of the nanostructured surface region to the receptor, the equilibrium is disturbed. More image forming material, (the mobile species when heated above its melting point) will then flow from the bulk of the binder to replenish the nanostructured surface region.

Because of the high interfacial free energy believed to be associated with the nanostructured surface region, it is believed the actual image forming material concentration in that region may be controlled by the interfacial energy rather than the bulk solubility of the image forming material in the binder. In this respect, a truly porous binder layer, with submicroscopic pores, too small to cause light scattering but sufficient to permit the image forming material to phase separate and form nanostructure-sized pure image forming material domains around the nanostructured elements, would be advantageous.

In addition to the capillary action stemming from the high interfacial surface energy of the nanostructured surface region, increased solubility of the image forming material in the heated binder, the concentration gradient, and the strong temperature dependence of diffusion coefficients may contribute to the chemical potential driving the image forming material from the bulk composite layer of the donor medium into the still heated volume within the nanostructured surface region immediately after a pulse.

As a result, the donor sheet is reusable for multiple images. A further consequence and advantage of pumping, the amount of image forming material transferred per pulse of illuminating radiation remains constant. For example, when a dye is the image forming material, this allows the optical density of an image to be controlled by the number of pulses (or "color quanta"), as well as the intensity of the pulses.

A particularly useful process for making the nanostructured surface region of the donor medium used to demonstrate this invention is described in U.S. patent application Ser. No. 07/681,332, filed Apr. 5, 1991 and such description is incorporated herein by reference. The nanostructured elements comprising the nanostructured surface region are described in U.S. Pat. Nos.

5,039,561 and 4,812,352 and such description is incorporated herein by reference.

Figure 2:
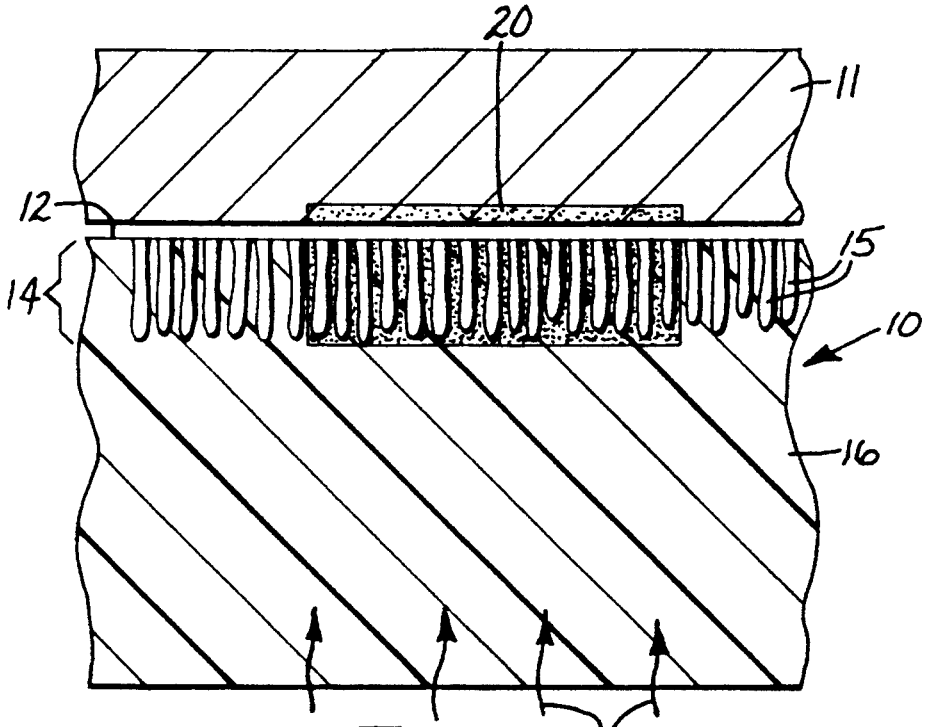
FIG. 2 is a cross-section view of the donor sheet of FIG. 1 in contact with a receptor sheet.
Figure 3:
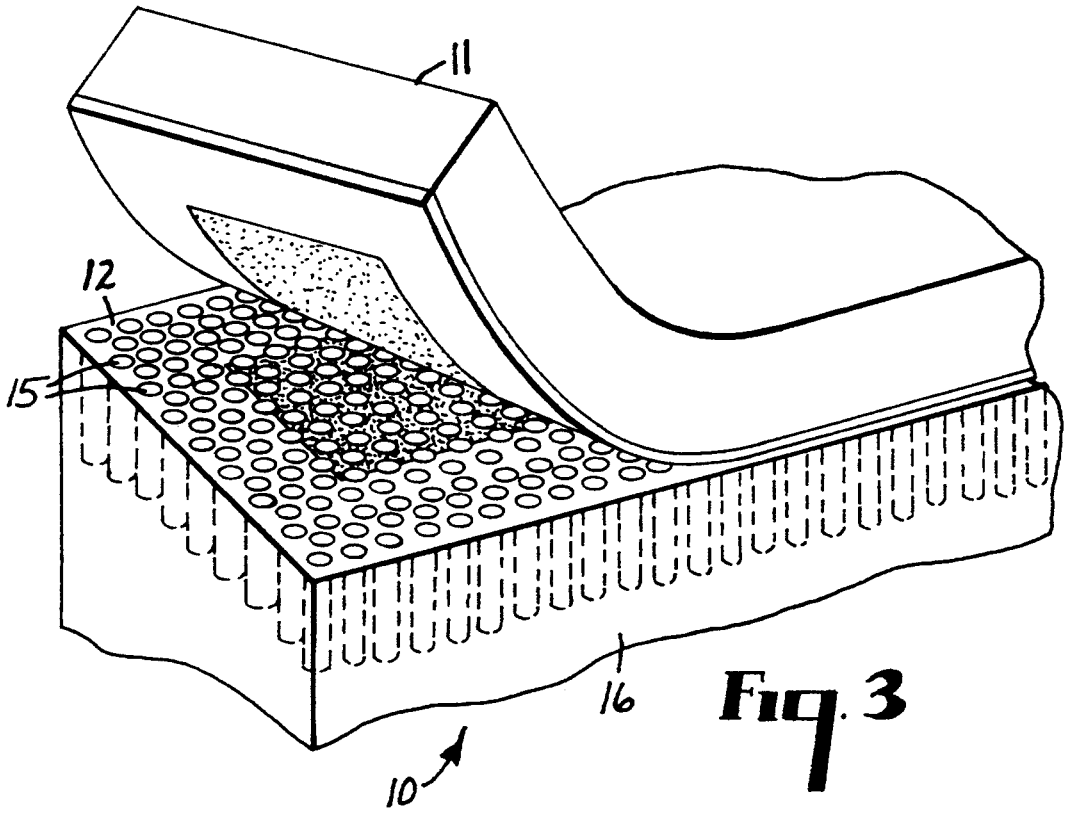
FIG. 3 is a perspective view of the receptor sheet being separated from the donor sheet after an image forming material has been thermally transferred.

Referring to FIGS. 1–3, nanostructured surface region (14) is comprised of high aspect ratio crystalline whiskers (2) comprised of an organic pigment grown such that their long axes are perpendicular to a temporary substrate (1), such as copper-coated polyimide. Whiskers (2) are discrete, oriented normal to substrate (1), predominantly noncontacting, have cross-sectional dimensions on the order of 0.05 μm or less, lengths of 1–2 μm and areal number densities of approximately 40–50/$\mu m^2$. Whiskers (2) are then coated with a thin metal shell (3), for example, by vacuum evaporation, chemical vapor deposition, or sputter deposition, sufficient to make the nanostructured elements (15) highly optically absorbing. Nanostructured elements (15) are embedded in an encapsulant (16). This is accomplished by coating nanostructured elements (15) with a liquid or liquid-like encapsulant and then curing. Alternatively, nanostructured elements (15) are embedded into a solid or solid-like encapsulant by hot roll calendering, using sufficient heat and force to embed the elements without damaging the elements. Nanostructured surface region composite donor medium (10) (also referred to as "donor medium") is then peeled off temporary substrate (1), cleanly carrying nanostructured elements (15) along, embedded on at least one major surface (12) of donor medium (10).

For example, encapsulant (16) may be a solution of polymer precursor and a dye (21). This provides the donor medium (10) represented in FIGS. 1–3, wherein dye molecules (21) resides in solution everywhere in encapsulant (16), in the interstices between nanostructured elements (15) as well as the bulk of the encapsulant (16). Preferably, the concentration of the dye (21) is higher in the nanostructured surface region (20) than in the encapsulant (16).

Donor medium (10) described herein can be used for imaging and printing full color, hard copy on various coated or uncoated papers or other medium used in digital proofing, contact proofing, medical imaging, graphic arts or personal printer output, by means of electronically addressed laser exposure or full area broad band radiation exposure through a mask. In a more general utility, the invention can be used to apply to a surface, imagewise, many materials other than dyes or pigments, such as surfactants, sensitizers, catalysts, initiators, cross-linking agents and the like.

FIGS. 1–3 merely illustrate a general imaging composite donor medium. Contemplated to be within the scope of the present invention are various configurations of the present invention. Among the various configurations contemplated are the following non-limiting examples:

(1) The donor medium illustrated in FIGS. 1–3 may be constructed with an image forming material bulk reservoir layer, for example a layer containing 100% of the image forming material or a transparent porous image forming material filled layer. The additional layer would be laminated to the encapsulant (16) on the surface opposite the nanostructured surface region (14).

(2) The nanostructured elements may be embedded into a layer made up of up to 100% by weight of the image forming material. The balance of the layer is comprised of a a film forming binder. Typically, as the percent of image forming material approaches 100% by weight, an additional transparent substrate may be laminated to the image forming material layer on the surface opposite the nanostructured surface region (14). This substrate will generally provide protection and support for the image forming layer.

(3) The nanostructured elements may be embedded into a thin film of porous or permeable polymer. Initially, this polymer would not contain any image forming material. Then in sequential order would be a layer containing from up to 100% by weight of an image forming material and a transparent substrate. The balance of the layer is comprised of a a film forming binder. These additional layers would be laminated to the surface of the porous or permeable polymer on the surface opposite the nanostructured surface region (14).

Figure 10:
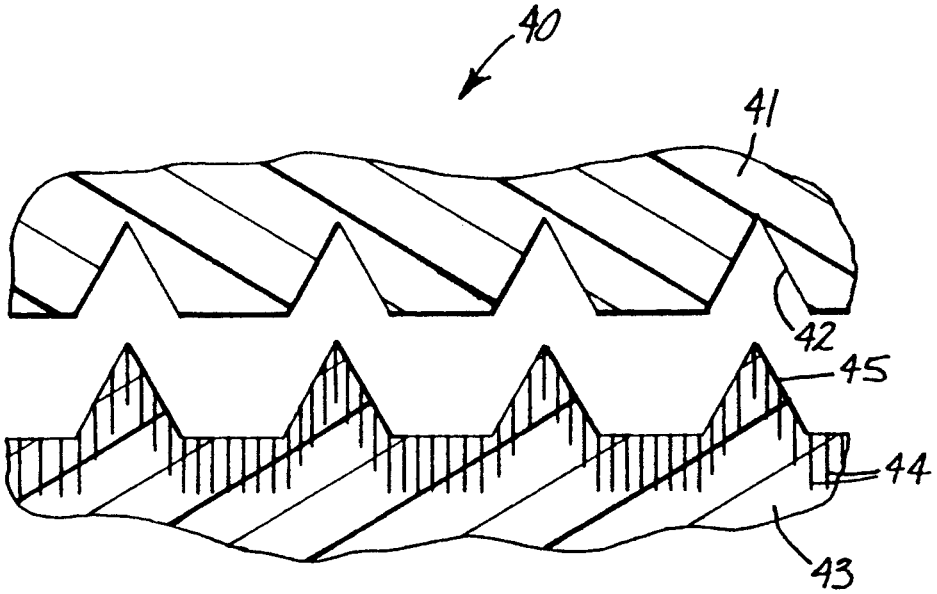
FIG. 10 is a schematic representation of an alternative configuration of a donor medium of the present invention.

(4) Any of the previously described constructions could also be constructed such that the temporary substrate was embossed and produced a gross topology wherein the nanostructured elements were embedded in the upper surface of the gross topology. A conceptual schematic is shown in FIG. 10. For example, referring to FIG. 10, a temporary substrate (40) having a gross topology would be useful for constructing a nanostructured donor media (40) having a plurality of large topological features (45). The nanostructured elements (44) are embedded in the encapsulant (43). Although, the topological featrues are illustrated as triangular, they could be any geometric shape. Alternatively, a gross topology can also be obtained by constructing a donor medium having an apparently planar surface and then subjecting this donor medium to an embosser.

Materials useful as temporary substrate (1) for the present invention include those which maintain their integrity at the temperatures and pressures imposed upon them during any deposition and annealing steps of subsequent materials applied to the temporary substrate. The temporary substrate may be flexible or rigid, planar or non-planar, convex, concave, aspheric or any combination thereof. Furthermore, the temporary substrate may be embossed or otherwise patterned, in which case, when the temporary substrate is removed, the nanostructured surface region will maintain the gross topological features (in reverse) of the temporary substrate (see FIG. 10).

Preferred temporary substrate materials include organic or inorganic materials, such as, polymers, metals, ceramics, glasses, semiconductors. The preferred organic substrate is metal coated polyimide film (commercially available from DuPont Corp. under the trade designation KAPTON). Additional examples of substrate materials appropriate for the present invention can be found and described in U.S. Pat. No. 4,812,352 and such description is incorporated herein by reference.

Starting materials useful in preparing whiskers (2) include organic and inorganic compounds. Whiskers (2) are essentially a non-reactive or passive matrix for the subsequent thin metal coating and encapsulant. Several techniques or methods are useful for producing the whisker-like configuration of the particles. Methods for making inorganic-, metallic-, or semiconductor-based microstructured-layers or microstructures are described in *J. Vac. Sci. Tech. A* 1983, 1(3), 1398–1402; U.S. Pat. Nos. 4,969,545; 4,252,864; 4,396,643; 4,148,294; 4,155,781; and 4,209,008, and such descriptions are incorporated herein by reference.

Useful organic compounds include planar molecules comprising chains or rings over which $\pi$-electron density is extensively delocalized. These organic materials generally crystallize in a herringbone configuration.

Preferred organic materials can be broadly classified as polynuclear aromatic hydrocarbons and heterocyclic aromatic compounds. Polynuclear aromatic hydrocarbons are described in Morrison and Boyd, *Organic Chemistry,* 3rd ed., Allyn and Bacon, Inc. (Boston, 1974), Chap. 30. Heterocyclic aromatic compounds are described in Chap. 31 of the same reference.

Preferred polynuclear aromatic hydrocarbons include, for example, naphthalenes, phenanthrenes, perylenes, anthracenes, coronenes, and pyrenes. A preferred polynuclear aromatic hydrocarbon is N,N'-di(3,5-xylyl)perylene-3,4:9,10 bis(dicarboximide) (commercially available from American Hoechst Corp. under the trade designation of "C. I. Pigment Red 149") [hereinafter referred to as "perylene red"].

Preferred heterocyclic aromatic compounds include, for example, phthalocyanines, porphyrins, carbazoles, purines, and pterins. More preferred heterocyclic aromatic compounds include, for example, porphyrin, and phthalocyanine, and their metal complexes, for example, copper phthalocyanine (commercially available from Eastman Kodak).

The organic material used to produce whiskers may be coated onto a temporary substrate using well-known techniques in the art for applying a layer of an organic material onto a substrate including but not limited to vacuum evaporation, sputter coating, chemical vapor deposition, spray coating, Langmuir-Blodgett, or blade coating. Preferably, the organic layer is applied by physical vacuum vapor deposition (i.e., sublimation of the organic material under an applied vacuum). The preferred temperature of the temporary substrate during deposition is dependent on the organic material selected. For perylene red, a substrate temperature near room temperature (i.e., about 25° C.) is satisfactory.

In a particularly useful method for generating organic whiskers, the thickness of the deposited organic layer will determine the major dimension of the microstructures which form during an annealing step. Whiskers are grown on a temporary substrate with the characteristics and process described in U.S. patent application Ser. No. 07/271,930, filed Nov. 14, 1988 and such descriptions are incorporated herein by reference. This process for obtaining the whiskers is also described in Example 1 herein below.

An alternative process for generating the whiskers includes depositing a whisker-generating material on a temporary substrate wherein the whisker-generating material and the temporary substrate are at an elevated temperature. Material is then deposited until high aspect ratio randomly-oriented whiskers are obtained. The preferred process for obtaining the whiskers includes depositing the whisker-generating material at or near room temperature and then elevating the substrate temperature to anneal the whisker generating material.

In both instances, perylene red is the organic material preferred. When the organic material is perylene red, the thickness of the layer, prior to annealing is in the range from about 0.05 to about 0.25 μm, more preferably in the range of 0.05 to 0.15 μm. When the organic materials are annealed, whiskers are produced. Preferably, the whiskers are monocrystalline or polycrystalline rather than amorphous. The properties, both chemical and physical, of the layer of whiskers are anisotropic due to the crystalline nature and uniform orientation of the microstructures.

Typically, the orientation of the whiskers is uniformly related to the temporary substrate surface. The whiskers are preferably oriented normal to the temporary substrate surface, that is, perpendicular to the temporary substrate surface. The major axes of the whiskers are parallel to one another. Preferably, the whiskers are substantially uniaxially oriented. The whiskers are typically uniform in size and shape, and have uniform cross-sectional dimensions along their major axes. The preferred length of each whisker is in the range of 0.1 to 2.5 μm, more preferably in the range of 0.5 to 1.5 μm. The cross-sectional width of each whisker is preferably less than 0.1 μm.

The whiskers preferably have a high aspect ratio, (i.e., length of whisker to diameter of whisker ratio is in the range from about 3:1 to about 100:1). The major dimension of each whisker is directly proportional to the thickness of the initially deposited organic layer. The areal number densities of the conformally coated nanostructured elements are preferably in the range of 40–50/$\mu m^2$.

The nanostructured elements, submicrometer in width and a few micrometers in length, are composites comprising the organic core whisker conformally coated with a thin metal coating. The conformal coating material should be an efficient radiation absorber at a given wavelength and is selected from the group consisting of an organic material, such as organic pigments, phthalocyanines or heterocyclic aromatic compounds, or a metallic material. Additionally, the conformal coating material will generally strengthen the nanostructured elements comprising the nanostructured surface region. Generally, the conformal coating material is selected to optimize the radiation to heat conversion and increase the spectral range of radiation absorption. Preferably, the coating material is selected from the group consisting of conducting metals, semi-metals and semiconductors. Such materials include Cr, Co, Ir, Ni, Pd, Pt, Au, Ag, Cu, Be, Mg, Sc, Y, La, Ti, Zr, Hf, V, Nb, Ta, Mo, W, Mn, Tc, Re, Fe, Ru, Os, Rh, Zn, Cd, Hg, B, Al, Ga, In, TI, C, Si, Ge, Sn, Pb, As, Sb, Bi, Se, Te and alloys thereof, such as CrCo, NiCr, PtIr. Preferably, the organic conformal coating material is selected from the group consisting of heterocyclic and polynuclear aromatic compounds. The wall thickness of the conformal coating surrounding the whiskers is in the range from about 0.5 nanometers to about 50 nanometers.

The conformal coating may be deposited onto the whiskers using conventional techniques, including, for example, those described in U.S. patent application Ser. No. 07/271,930, supra. Preferably, the conformal coating is deposited by a method that avoids the disturbance of the nanostructured surface region by mechanical or mechanical-like forces. More preferably, the conformal coating is deposited by vacuum deposition methods, such as, vacuum sublimation, sputtering, vapor transport, and chemical vapor deposition.

Although two-component nanostructured elements (such as those described above) are preferred, single component nanostructured elements are also contemplated by this invention. The single component elements have dimensions similar to the two component elements, however, the single component elements consist only of the conformal coating material.

Furthermore, whether the nanostructured elements are unixially oriented or randomly oriented, it is preferred that at least one point of each nanostructured element must contact a two-dimensional surface common to all of the nanostructured elements.

The encapsulant is such that it can be applied to the exposed surface of the nanostructured surface region in a liquid or liquid-like state, which can be solidified or polymerized. The encapsulant comprises a polymer or polymer-precursor and image forming materials. The encapsulant may be in a vapor or vapor-like state that can be applied to the exposed surface of the nanostructured surface region. Alternatively, the encapsulant is a solid or solid-like material, preferably powder or powder-like, which can be applied to the exposed surface of the nanostructured surface region, transformed (e.g., by heating) to a liquid or liquid-like state (without adversely affecting the nanostructured surface region composite), and then resolidified.

Preferred organic encapsulants are molecular solids held together by van der Waals' forces, such as organic pigments, including perylene red, phthalocyanine and porphyrins and thermoplastic polymers and co-polymers and include, for example, polymers derived from olefins and other vinyl monomers, condensation polymers, such as polyesters, polyimides, polyamides, polyethers, polyurethanes, polyureas, and natural polymers and their derivatives such as, cellulose, cellulose nitrate, gelatins, proteins, and natural and synthetic rubbers. Inorganic encapsulants that would be suitable, include for example, gels, sols, or porous semiconductors, or metal oxides applied by, for example, vacuum processes. Preferably, the thickness of the encapsulant is in the range from about 1 μm to about 1 mm, and more preferably in the range from about 6 μm to about 500 μm.

The encapsulant may be applied to the nanostructured surface region by means appropriate for the particular encapsulant. For example, an encapsulant in a liquid or liquid-like state may be applied to the exposed surface of the nanostructured surface region by dip coating, vapor condensation, spray coating, roll coating, knife coating, or blade coating or any other art known coating method. An encapsulant may be applied in a vapor or vapor-like state by using conventional vapor deposition techniques including, for example, vacuum vapor deposition, chemical vapor deposition, or plasma vapor deposition.

An encapsulant that is solid or solid-like may be applied to the exposed surface of the nanostructured surface region liquefied by applying a sufficient amount of energy, for example, by conduction or radiation heating to transform the solid or solid-like material to a liquid or liquid-like material, and then solidifying the liquid or liquid-like material.

The applied encapsulant may be solidified by means appropriate to the particular material used. Such solidification means include, for example, curing or polymerizing techniques known in the art, including, for example, radiation, free radical, anionic, cationic, step growth processes, solvent evaporaton, or combinations thereof. Other solidification means include, for example, freezing and gelling.

After the polymer is cured, the resulting composite article, that is, the donor medium of the present invention comprising a nanostructured surface region intimately encapsulated with a dye-containing binder layer is delaminated from the temporary substrate at the substrate:nanostructured surface region interface by mechanical means such as, for example, pulling the film from the temporary substrate, pulling the temporary substrate from the film, or both. In some instances, the film may self-delaminate during solidification of the encapsulant.

An alternative and preferred process is a solventless process for fabricating the donor medium. Although applicable in concept to any nanostructured surface component, that is, one comprising nanostructured elements of various material compositions, shapes, orientations, packing densities and specific light absorption properties, the description of the process refers to dye containing donor medium.

A dye or dyes (up to 100 wt. % of image forming materials) can be compounded with a suitable binder or polymer, and hot pressed or rolled to prepare dye loaded pre-donor medium sheets or webs. A mixture of powdered dyes, polymer pellets or powders and thermal stabilizers are first blended to form a homogeneous mixture. This mixture is then hot compounded in a commercially available compounder. The compounded mass of dye and polymer is then transformed into a web form between laminating sheets by heat and pressure during a calendering process.

Figure 12:
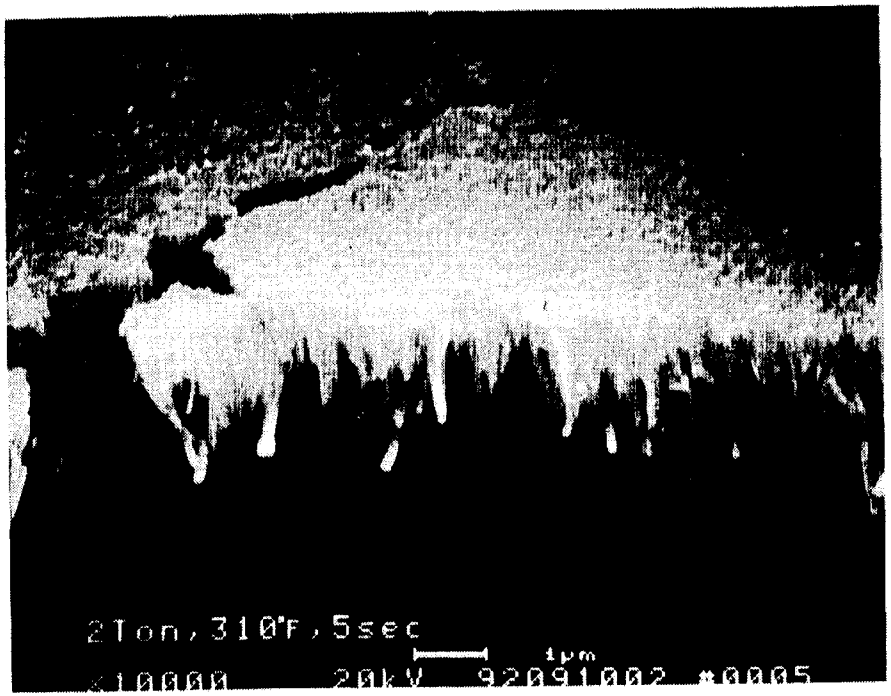
FIG. 12 is a scanning electron micrograph of the nanostructured elements after being embedded into the polymeric binder via hot roll calendering.

Next the nanostructured elements are hot pressed into the surface of the pre-donor medium sheet by a second calendering process, also using controlled heat and pressure. For example, the nanostructured elements are brought into contact with the dye-loaded pre-donor medium web at the nip of a pair of heated rollers. The temporary substrate (from the nanostructured elements) is then stripped away, leaving the nanostructured elements penetrating the dye-loaded pre-donor medium web in a manner that completely preserves their orientation and areal number density as illustrated in FIG. 12.

Alternatively, the nanostructured elements could be hot roll calendered into a polymer web. Once the elements have been embedded in the polymer web, this pre-donor medium sheet can then be laminated to a layer containing up to 100% dye. The lamination interface is between the 100% dye layer and the surface with the exposed nanostructured elements of the nanostructured surface region.

Image forming materials may be any materials that will diffuse through the binder portion of the encapsulant and are such that they are available for multiple use, that is, the image forming portion is not destroyed after a single image. Such materials include dyes, such as dispersion dyes, oil bath dyes, acid dyes, mordant dyes, vat dyes, and basic dyes used for thermal transfer. As concrete examples, dyes of azo dyes, anthroquinone group, nitro group, styryl group, and naphthoquinone group quinophthalone group, azomethine group, coumarin group and condensate polycyclic dyes. Other non-limiting examples of image forming materials are leuco dyes, thermally transferrable surfactants, sensitizers, catalysts, and initators.

For example, if the image forming material is too large, the molecules will be too large to diffuse through the binder portion of the encapsulant unless the temperature is raised passed the point of irreversible damage to the donor media. Other materials that would not be considered suitable are image forming containing polymers, that is, where the image forming portion is chemically bound to the backbone. For such materials to provide an image on the receptor, the image forming portion must be severed from the polymer, thus causing the material to be useful only for a single image. Further materials that would not be considered suitable are materials wherein the interaction energy of the image forming material or portion with the binder portion of the encapsulant would be so high as to require excessive temperatures to permit diffusion of the image forming material.

Advantageously, the present invention offers higher spatial resolution due to: (a) localization of the radiation absorption in the thin nanostructured surface region, (b) the absence of lateral light scattering parallel to the surface due to the highly efficient light absorption by the nanostructured elements, and (c) reduced heat diffusion laterally outside the irradiated area due to the separation of the nanostructured elements. In conventionally coated dye layers, the resolution can be affected by the thickness of the dye/binder layer required for adequate energy absorption.

Objects and advantages of this invention are further illustrated by the following examples, but the particular materials and amounts thereof recited in these examples, as well as other conditions and details, should not be construed to unduly limit this invention. All materials are commerically available or known in the art except where stated or otherwise made apparent.

EXAMPLES

In the following examples, donor medium are demonstrated comprising different nanostructured element lengths, different metal conformal coatings of various thicknesses, dyes, and polymers in the dye/binder encapsulants. Dye transfer is demonstrated to various receivers (white bond paper, 3M Rainbow TM receiver paper, a coated PET, and 3M Scotch TM brand Magic TM tape) using different radiation sources (a 3M transparency maker Model #4550A, 3M Promat TM xenon flash (Model 100 Letter Compositor), and a focused, pulsed laser diode).

EXAMPLES 1-3

These first three examples demonstrate dye sublimation transfer of yellow, cyan and magenta colors to plain white bond paper.

EXAMPLE 1

(1) Preparation of the Nanostructure Elements

A 0.050 mm thick polyimide sheet (ICI Films, Wilmington, Del.) was stretch-mounted between two stainless steel rings to form an 8.3 cm diameter disc. Copper was rf sputter-coated onto the polyimide (temporary substrate) disc to an approximate thickness of 200 nanometers (nm) mass equivalent at a rate of 40 nm/min (400 U/min). This provided a copperized temporary substrate on which was vacuum vapor deposited at $\sim 4\times 10^{-5}$ Pascals (Pa) ($3\times 10^{-7}$ Torr) and a rate of $\sim 8$ nm/min., an $\sim 100$ nm thick layer of the organic pigment N,N'-di(3,5-xylyl)perylene-3,4:9,10 bis(dicarboximide) [also referred to as "perylene red"].

The perylene red-coated, copperized polyimide film was then vacuum annealed by maintaining the back of the polyimide in contact with a heated copper disc at 280° C. for 40 minutes. This converted the initially uniform perylene red coating to a nanostructured surface region of discrete, perpendicularly oriented crystalline whiskers. The whiskers were 1-2 $\mu$m long, 0.05 $\mu$m wide (in cross-section), and had an areal number density of 40-50/$\mu m^2$.

The whiskers were then coated with Ag by rf sputtering a mass equivalent thickness of 150 nm of Ag over the entire whisker covered copperized polyimide film. This produced an actual Ag metal wall thickness around each whisker of $\sim 10$ nm. The resulting nanostructured film appeared dark gray.

(2) Encapsulation with Dye/Binder

A yellow dye/binder solution was prepared as follows: A yellow dye solution of 0.025 gms of LT Light Yellow (BASF Corp.) was added to $\sim 1$ ml of toluene. This was then combined with 11 ml of a 5% by weight toluene solution of poly(trimethylsilylpropyne) (PTMSP) (commerically available from Hüls Petrarch, Bristol, Pa.). This dye/binder solution was then poured over the Ag-coated nanostructured surface region described above. This solution encapsulated the Ag-coated whiskers without disturbing them. The encapsulated nanostructured elements were partially covered and allowed to dry overnight at room temperature. The resulting composite film (dried 4.5% by weight dye/PTMSP) self-delaminated from the copperized polyimide, cleanly pulling the whiskers off the copper coating, giving an $\sim 0.07$ mm thick donor medium construction as illustrated in FIG. 1.

(3) Imaging

A 1 cm square piece of the resulting donor medium was placed whisker-side down onto white bond paper and the latter passed through an overhead visual transparency maker (3M Co., Model #4550AGA) at a time dial setting of 3.5. A partial yellow image of the piece was formed on the white bond paper. The same donor medium sample piece was moved to a series of adjacent spots on the white bond paper and passed through the transparency maker with the time dial setting decreased (thus increasing the heating exposure) to 3.0, 2.5, 2.0, and 1.5 for successive spots. The yellow image density increased respectively.

The donor medium sample piece was then turned over, thus putting the whiskered-side away from the paper receptor, and again passed through the transparency maker. No yellow dye was transferred to the paper, illustrated the necessity of having the heat absorbing whiskers adjacent to the receptor.

A second piece of the donor medium, 1.5 cm$\times$2 cm, was placed whisker-side down on white bond paper and passed through the transparency maker, at a time dial setting of 1.5, a total of 10 times, each time in a different position on the paper receiver. The brightness of the 10 yellow images decreased with each pass. The yellow optical densities (O.D.) of the first two images were measured with a Gretag Model SPM100/LT densitometer using D50 illumination and ANSI Status T filter. The average of three yellow readings from the first image was $0.7\pm 0.05$, and from the second image was $0.53\pm 0.05$.

A third piece of the donor medium, varying in width from $\sim 6$ mm to 12 mm and 4 cm long, was placed whisker-side down onto white bond paper and exposed to a xenon flash (3M Promat TM Model 100 Letter Compositor). A first yellow image, with yellow O.D. of $\sim 0.24$ and shaped like the sample, was produced on the paper by giving the sample 6 flashes in quick succession ($\sim 2$ seconds apart). A second image having an O.D. of 0.31 was produced with 12 flashes of the lamp, and a third image having an O.D. of 0.30 was produced with 24 flashes. Six further images were also produced using either 12 or 24 flashes having an average O.D. of 0.25 for the 12 flash images and 0.30 for the 24 flash images.

EXAMPLE 2

A whiskered (perylene red) copperized polyimide substrate was prepared as in Example 1. A mass equivalent thickness of 200 nm of Cu was rf-sputter coated onto the whiskers. A cyan dye/binder solution was prepared by combining 0.034 gm of Foron TM Brilliant Blue (commercially available from Sandoz Chemicals Corp.) in 1 ml of toluene, with 9 ml of the 5% by wt. PTMSP/toluene solution described in Example 1. The resulting dye/binder was poured over the whiskered copperized polyimide substrate and allowed to dry as described Example 1. The resulting ~0.18 mm thick donor film containing 7.6% by wt. cyan dye in PTMSP self-delaminated from the copperized polyimide, leaving it (temporary substrate) medium bright and clean.

Transfer of the cyan dye to white bond paper was made using the same transparency maker described in Example 1 with the whisker side of the donor medium sample piece against the paper receptor. Multiple images were made from the same donor medium sample piece with increasing dye transfer as the time dial setting decreased (from 3.5 to 1.5) as described in Example 1 (3). No transfer occurred where nanostructured elements were absent from the donor medium, for example, on the edges of a sample. Multiple images were made with a single piece. At a transparency maker setting of 1.0, the seventh and ninth images had maximum cyan optical densities of 0.42 and 0.51 respectively, measured as described in Example 1, although the images were non uniform.

EXAMPLE 3

A whiskered (perylene red) coated copperized polyimide substrate was prepared as described in Example 1. A mass equivalent thickness of 100 nm of Ag was rf sputtered onto the whiskers. A magenta dye/binder solution was prepared by combining 0.0355 gm of Magenta HSR-31 (available from Mitsubishi Kasei) in 1 ml of toluene, with 9 ml of the 5% by wt. PTMSP/toluene solution as described in Example 1. The resulting dye/binder was poured over the whiskered coated copperized polyimide substrate and allowed to dry as described in Example 1. The resulting 0.1 mm thick donor medium containing 9.1% by wt. magenta dye in PTMSP self-delaminated from the copperized polyimide.

Eight image transfers of the magenta dye to white bond paper were made from a single piece of the sample using the transparency maker described in Example 1 and time dial settings from 2.5 to 1.5 with the nanostructured side of the donor against the paper receptor. Magenta dye transfer to white bond paper was also made with a 2.5 cm square piece using the xenon flash described in Example 1. Eight images from the same sample piece were made using from 6 to 24 flashes per image. The images appeared very uniform in color. The magenta O.D. was measured for the first three images respectively as 0.130 (6 flashes), 0.175 (24 flashes) and 0.125±0.005 (6 flashes).

EXAMPLES 4 AND 5

Examples 4 and 5 demonstrate dye transfer of a magenta dye/binder formulation to thermal dye transfer receiver paper and a coated PET receptor by both xenon flash and laser diode illumination. The examples show several tens of images can be produced from a donor medium without loss of optical density, that at a wavelength of 830 nm, the laser diode sensitivity to a transparent receptor with 13 micrometers (μm) dots is ~0.4 J/cm$^2$, and the resolution of text produced by illumination through a mask is subjectively (qualitatively) estimated at ~1000 dots/inch (dpi).

EXAMPLE 4

A perylene red whisker-coated copperized polyimide substrate was prepared as in Example 1, except nominally 200 nm of perylene red was deposited and annealed to produce oriented whiskers approximately 1.5 to 2 μm tall. A mass equivalent thickness of 150 nm of Pt was rf-sputter coated onto the whiskers. One half of the sample disc was encapsulated with 3.5 ml of a magenta dye/binder solution by pouring the encapsulating solution over the whiskered disc and allowing it to dry over a weekend at room temperature as in Example 1.

The encapsulating solution was 10% by weight solids in THF (15%), cyclohexanone (45%) and MEK (40%). The solids consisted of 33.68% Magenta HSR-31 (see Example 3), 8.42% butyl magenta (N,N-dibutyl-4-(tricyanovinyl)aniline described in McKusick et al. *JACS* 80 (1988) 2806–15), 39.4% polyvinyl chloride (available from BF Goodrich Chem. Group, under the trade designation GEON 178), 2.8% Vitel PE200 polyester (available from Goodyear Tire and Rubber Co., Chemicals Div.), and 15.7% surfactant (available under the trade designation TROYSOL CD-1 from Troy Chem Corp.).

After drying, the sample was cut from the steel ring, and immersed in liquid nitrogen to cause the donor medium to "pop" cleanly off the copperized polyimide temporary substrate. The resulting 40% by wt. dye/polymer donor medium varied in thickness from 0.0025" to 0.007", (68–178 μm).

An edge piece ~2.5 cm long×3 mm wide and 120 mm thick was placed nanostructured element side down onto Rainbow TM thermal dye transfer receiver paper (available from 3M Co., Printing and Publishing Systems Div.) and given a series of single flashes at different positions on the receiver with the Promat TM xenon flash unit of Example 1. Twenty seven images were produced in quick succession which appeared very nearly identical with a magenta O.D. of 0.25.

A second rectangular piece 3.2 cm×1.3 cm and ~100 μm thick was placed against the Rainbow TM receiver. A single xenon flash produced an image of magenta O.D. of 0.53. Two flashes gave a second image having an O.D. of 0.43, 4 flashes gave a third image having an O.D. of 0.60 and 8 flashes gave a fourth image having an O.D. of 0.76.

Figure 4:
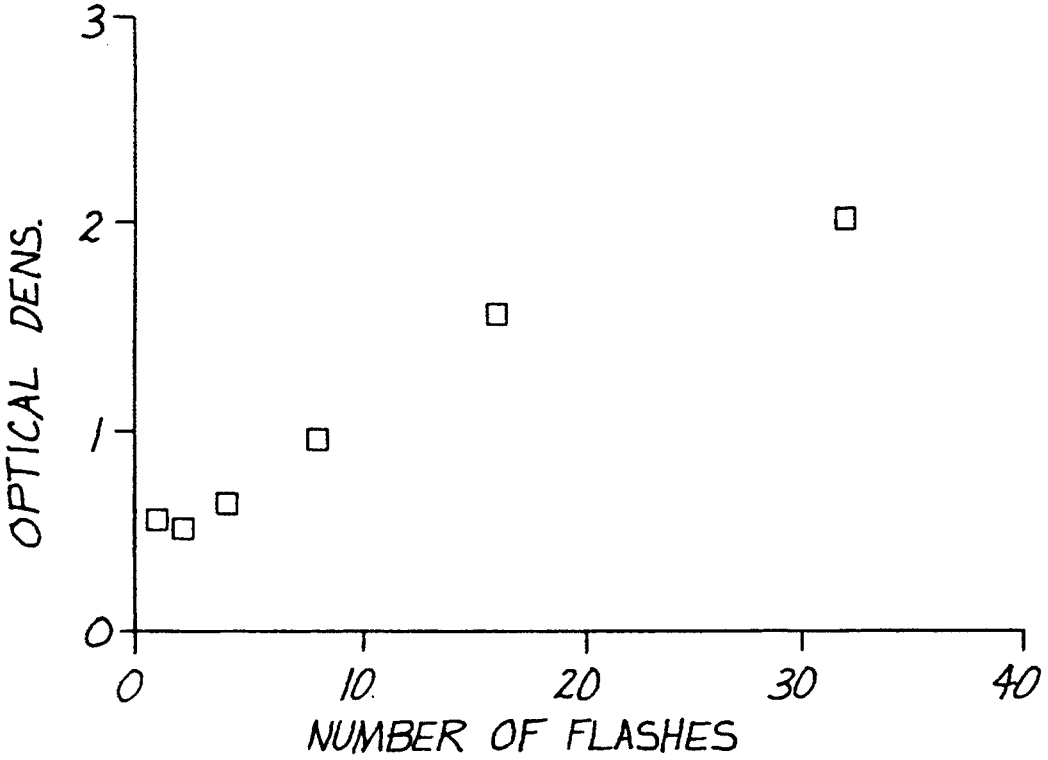
FIG. 4 is a graphical representation of a magenta dye optical density as a function of the number of xenon flashes per image.

A third piece ~2 cm square with thickness varying from 68 to 178 μm was placed nanostructured element side down onto the Rainbow TM receiver. Eight sequential images were produced beginning with a single xenon flash, then two flashes, four flashes and so forth to 32 flashes. FIG. 4 shows the variation in magenta O.D. measured with the Gretag instrument as a function of the number of flashes per image.

A fourth piece was used to repeatedly image text onto the Rainbow TM receiver using a 35 mm photographic negative of fine print (23 letters/cm) as a mask for the xenon flash. Twenty-four images were made without moving the mask relative to the donor film. The last and first were equally legible. The sharpness of the letter edges was independently judged by inspection to be equivalent to a resolution of 1000 dpi.

EXAMPLE 5

A fixed-point laser diode-based sensitometer was used to expose a piece of the donor film from Example 4, transferring magenta dye dot-wise to a transparent coated polyester receiver sheet.

The sensitometer consists of a Sanyo 100 mW laser diode operating at 822 nm, collimating and circularizing optics, and a 4 cm focal length focussing lens. This lens focusses a 74 mW beam to a nearly circular 13 μm spot ($1/e^2$ width) at the focal plane. A heated aluminum block incorporating vacuum-assisted medium hold-down features is positioned at this focal plane. Both the laser pulse exposure time and peak pulse power can be varied using standard diode driver and pulse generator circuitry.

The receiver sheet was ~4 mil (100 μm) thick coated polyester (U.S. patent application Ser. No. 07/753,862, filed Sep. 3, 1991).

The donor sample piece was laid on the aluminum block, maintained at 40° C., with the nanostructured elements side up. A larger piece of receiver sheet was laid over the sample piece with the coated side against the donor's nanostructured elements surface. Vacuum was applied to cause the PET receiver to be pressed against the donor sample. The laser diode was pulsed first with a 6.5 μsec time length, while translating the sample stage so as to produce a series of five dye transfer spots. The first spot was made with one pulse, the second with two, then four, eight and finally sixteen 6.5 μsec pulses. This process was repeated for 10 μsec and 15 μsec pulse lengths. The 6.5 μsec dots appear to be 7–9 μm in diameter and to vary in density with the number of pulses. The 10 μsec pulses produced somewhat larger dots from 8 to 12 μm in diameter and the 15 μsec pulses give dots ~15 μm in diameter. The O.D. of all the dots was so high they appeared black under ordinary microscope lighting, and magenta under intense illumination.

A second set of such multiple pulsed dye transfers were made for the same pulse lengths as just described, but with the aluminum block cooled to room temperature (23–24° C.). The results were very similar to those in the previous paragraph except the single 6.5 μsec pulse's dot was absent.

A different set of pulsed exposures were carried out as follows. For each pulse length of 2 to 10 μsec, a series of single pulse dot images were produced as the sample was translated under the beam. With the aluminum block at 40° C. the string of 5 μsec dots are barely visible under a microscope. The 6–10 μsec dots can be clearly seen. The 7 μsec dots appear quite uniform and ~8 μm in diameter. This process was then repeated with a block temperature of 24° C. The 5–10 μsec spots were all clearly seen, and several of the 4 μsec spots.

EXAMPLE 6

A nanostructured donor sample was prepared using the magenta dye/binder described in Example 5 to encapsulate short (~1 μm long) perylene red whiskers sputter coated with 100 nm mass equivalent of Ag. The donor medium was heated for 30 minutes at 80–82° C. in a conventional vacuum oven to further dry off the cyclohexanone. The donor medium was delaminated by peeling it off the copper coated polyimide temporary substrate.

Transfer to the Rainbow TM receiver was demonstrated using the xenon flash and laser diode units as described in Example 5, except the donor medium was placed nanostructured element-side down on top of the receiver and the laser was incident on the back of the donor medium as shown in FIG. 2.

A piece of donor medium with a thickness of 0.090 mm to 0.12 mm was given a series of multiple xenon flashes at five different locations on the receiver. Despite the thickness variation, the images appeared quite uniform. The average Gretag measured O.D.'s were 0.28±0.01 for 1 flash (first image), 0.425±0.005 for 2 flashes, 0.379±0.005 for 4 flashes, 0.54±0.04 for 6 flashes and 0.84±0.04 for the last 16 flash image.

For the laser exposure the same series of 1, 2, 4, 8 and 16 multiple pulses per dot were done as described in Example 5, but with pulse lengths of 37.5 μsec. Single pulse exposures were done at 75 μsec and 150 μsec pulse lengths. The dots in all cases had very sharp edges. The 75 μsec dots were approximately 20 μm in diameter. The 37.5 μsec pulses were smaller.

EXAMPLE 7

Laser dye transfer from the same donor medium as described in Example 6 to the transparent coated PET receiver described in Example 5 was demonstrated. One, two, four, eight and sixteen pulses were used to make five dots on the receiver for each of 15, 20, 25 and 30 μsec pulse times. All dots were clearly visible for all pulse times and indicated an increase in dot size and/or density with number of pulses.

EXAMPLE 8

A nanostructured donor medium was prepared using the magenta encapsulating dye/binder described in Example 5 to encapsulate "long" (~1–2 μm) perylene red whiskers, which had been coated with ~100 nm mass equivalent of Ag by evaporation. As in Example 6, the sample was vacuum dried at 80° C. for 30 minutes before delamination by peeling away the copperized polyimide. Dye transfer to the Rainbow TM receiver was done by both xenon flash and laser diode exposure.

A piece of the donor medium approximately 6 mm wide and 3 cm long was used to make a series of 11 images by xenon flash with varying numbers of flashes per image. The dye transfer effectiveness remained high after these images. The average magenta optical densities of seven single flash images was 0.36. One two flash image was had and O.D. of 0.36. The average O.D. of two four-flash images was 0.49, and for one eight flash image had an O.D. of 0.69.

Laser exposure to the Rainbow TM receiver was carried out with 37.5 μsec pulses, incident on the back of the donor film as described in Example 6. The aluminum block was not heated. Multiple pulses doubling from 2 to 16 all produced very small but visible spots under a microscope. The density increased with pulse number.

EXAMPLES 9–12

Examples 9–12 demonstrate nanostructured surface composite donor films comprising cyan and magenta dyes in methacrylate polymers having varying glass transition temperature.

EXAMPLE 9

A nanostructured donor medium was prepared using the cyan dye of Example 2 blended in very high MW poly(ethyl methacrylate) (PEMA, $T_g$=65° C.), for encapsulating long (~1.5–2 μm) perylene red whiskers sputter coated with 100 nm mass equivalent of Ag. The whiskers had been grown on a stretched 8 cm diameter copper coated polyimide temporary substrate mounted in stainless steel rings as in all previous examples.

Twenty-five ml of a 10% by wt. solution of PEMA in toluene was mixed with 3.2 ml of a 3.46% by wt. solution of the cyan dye in toluene. Approximately 5.5 ml of that solution was cast onto half the 8 cm diameter whiskered structure and dried overnight at room temperature. The resulting 7.1% by wt. dye/polymer donor medium was peeled from the polyimide temporary substrate.

A rectangular piece 1 cm×3 cm and with thickness of 0.096 mm was imaged with the xenon flash onto Rainbow TM receiver. A single flash gave a cyan O.D. of 0.17, and an O.D. of 0.24 for four flashes and an O.D. of 0.24 for eight flashes.

EXAMPLE 10

A nanostructured donor medium was prepared by using the magenta dye of Example 3 in high MW poly(-butyl methacrylate) (PBMA, $T_g$=20° C.) for the encapsulant of short (~1 μm) perylene red whiskers coated with 83 nm mass equivalent of evaporated Ag. The whiskers had been grown on the stretched 8 cm diameter copper coated polyimide temporary substrate mounted in stainless steel rings as in all previous examples.

Twenty-five ml of a 10% by wt. solution of PBMA in toluene was mixed with 3.0 ml of a 3.86% by wt. solution of the magenta dye in toluene. Approximately 5.5 ml of that solution was cast onto half the 8 cm diameter whiskered structure and dried overnight at room temperature. The resulting 7.4% by wt. dye/polymer donor medium was peeled from the polyimide temporary substrate.

A 1.8 cm square, 0.077 mm thick piece of the just described donor medium was placed nanostructured elements-side down onto the Rainbow TM receiver and imaged with the Promat TM xenon flash unit. Two flashes produced an initial image with an average magenta O.D. of 0.46±0.03. A second two-flash image had an O.D. of 0.28. Four flashes produced a third image with an O.D. of 0.30. A final single flash image had an O.D. of 0.15±0.015.

EXAMPLE 11

A nanostructured donor medium was prepared by using the magenta dye of Example 3 in poly(ethyl methacrylate) (PEMA) for the encapsulant of short (~1 μm) perylene red whiskers coated with 83 nm mass equivalent of evaporated Ag. The whiskers had been grown on the stretched 8 cm diameter copper coated polyimide temporary substrate mounted in stainless steel rings as in all previous examples.

Twenty-five ml of a 10% by wt. solution of PEMA in toluene was mixed with 3.0 ml of a 3.86% by wt. solution of the magenta dye in toluene. Approximately 5.5 ml of that solution was cast onto half the 8 cm diameter whiskered structure and dried overnight at room temperature. The resulting 7.4% by wt. dye/polymer donor medium was peeled from the polyimide backing.

A 0.9 cm×2.2 cm sized piece of the just described donor medium, ranging in thickness from 0.09 mm to 0.12 mm, was used to image onto the Rainbow TM receiver with the xenon flash. A first single flash produced a magenta O.D. of 0.17±0.05. Two flashes gave a second image having an O.D. of 0.195±0.005. Four flashes gave a third image having an O.D. of 0.235±0.005.

EXAMPLE 12

A nanostructured donor medium was prepared by using the cyan dye of Example 2 in medium MW poly(-methyl methacrylate) (PMMA, $T_g$=105° C.) for the encapsulant of long (~1.5–2 μm) perylene red whiskers sputter coated with 100 nm mass equivalent of Ag. The whiskers had been grown on the stretched 8 cm diameter copper coated polyimide temporary substrate mounted in stainless steel rings as in all previous examples.

Twenty-five ml of a 10% by wt. solution of PMMA in toluene was mixed with 3.2 ml of a 3.46% by wt. solution of the cyan dye in toluene. Approximately 5.5 ml of that solution was cast onto half the 8 cm diameter nanostructured elements and dried overnight at room temperature. The resulting 7.1% by weight dye/-polymer donor medium was peeled from the polyimide temporary substrate.

A rectangular piece 1 cm×2 c with thickness varying between 0.07 and 0.11 mm was imaged with the xenon flash onto Rainbow TM receiver as in previous examples. A single flash gave an image with an O.D. of 0.103±0.002. Two flashes gave an O.D. of 0.113±0.003, and four flashes gave an O.D. of 0.158±0.005.

EXAMPLE 13

The magenta/PEMA donor medium of Example 11 was used to demonstrate dye transfer to ordinary white bond paper with the xenon flash. A first single xenon flash gave a maximum magenta O.D. of 0.155. A second image with four flashes gave an O.D.=0.18. A third image with two flashes had an O.D.=0.15.

EXAMPLE 14

The magenta/PBMA donor medium of Example 10 was used to demonstrate dye transfer to ordinary white bond paper with the xenon flash. A first single flash gave a maximum magenta O.D.=0.17. A second image with four flashes gave an O.D.=0.17. A third image with two flashes had an O.D.=0.16.

EXAMPLES 15–18

Examples 15–18 demonstrate efficient dye transfer to Scotch TM brand Magic TM tape as the receiver layer.

EXAMPLE 15

The cyan/PMMA donor film of Example 12 was used to demonstrate dye transfer to Scotch TM brand Magic TM tape (No. #811). A 1 cm×2 cm piece of donor medium was adhered with its nanostructured elements side to a piece of adhesive tape. A single flash produced a uniform, highly colored image with cyan O.D.=0.665±0.005 as measured with the tape transferred to white bond paper. The cyan O.D. of the tape on the white background was 0.115 for comparison. Multiple images could be produced from the same piece of donor medium.

EXAMPLE 16

The cyan/PEMA donor medium of Example 9 was used to demonstrate dye transfer to Scotch TM brand Magic TM tape (No. #811). A 1 cm×3 cm piece of donor medium was adhered with its nanostructured elements side to a piece of adhesive tape. Four flashes produced a uniform, highly colored first image with cyan O.D.=0.62±0.03, as measured with the tape transferred to white bond paper. A second single flash image had an optical density of 0.42±0.01. A third image from two flashes had an O.D.=0.414±0.005. A fourth image from four flashes had an O.D.=0.380±0.005. The cyan O.D. of the tape on the white background was 0.115 for comparison.

EXAMPLE 17

The same donor medium piece used in Example 13 was also used for xenon flash transfer to Scotch TM brand Magic TM tape (No. #811) as described in Example 15. A single flash produced a maximum magenta O.D.=0.45 as measured with the imaged tape piece applied to bond paper.

EXAMPLE 18

The same donor medium piece used in Example 14 was also used for xenon flash transfer to Scotch TM brand Magic TM tape (No. #811) as described in Example 15. A single flash produced a maximum magenta O.D.=0.45 as measured with the imaged tape piece applied to bond paper. The image density was very uniform over the 1.2×3 cm piece.

EXAMPLE 19

This example illustrates the thermal transfer of a leuco dye color former to a coated paper receiver.

A 12.7% by weight solids in tetrahydrofuran (THF) was prepared by combining: 3.0 grams of Pergascript Black IR color (commerically available from Ciba Geigy), 7.06 gms of GEON 178 PVC, 0.34 gms of VITEL 200 polyester, 0.22 gms of TROYSOL CD-1 (previously identified), and 90 ml of THF.

6.5 ml of this solution was poured onto a sample of Ag coated whiskers as prepared in Example 1, except that a mass equivalent of 30 nm of Ag was sputtered onto the whiskers. After drying at ambient temperature, the encapsulated whisker layer (donor medium) easily peeled off the copper coated polyimide temporary substrate.

The donor medium with the leuco color former was placed nanostructured elements-side down, against a sheet of SCOTCHMARK TM receiver paper (available from 3M Co.). Six black images were formed on the SCOTCHMARK TM paper using the Promat TM xenon flash (previously identified) and a single piece of donor medium. Since the image appeared black, and the black color former is made up of multiple colors, all colors were apparently transferred to the same degree.

EXAMPLE 20

This example demonstrates the large number of images possible and the effect of thermal biasing (warming) the sample on sensitivity.

Figure 5:
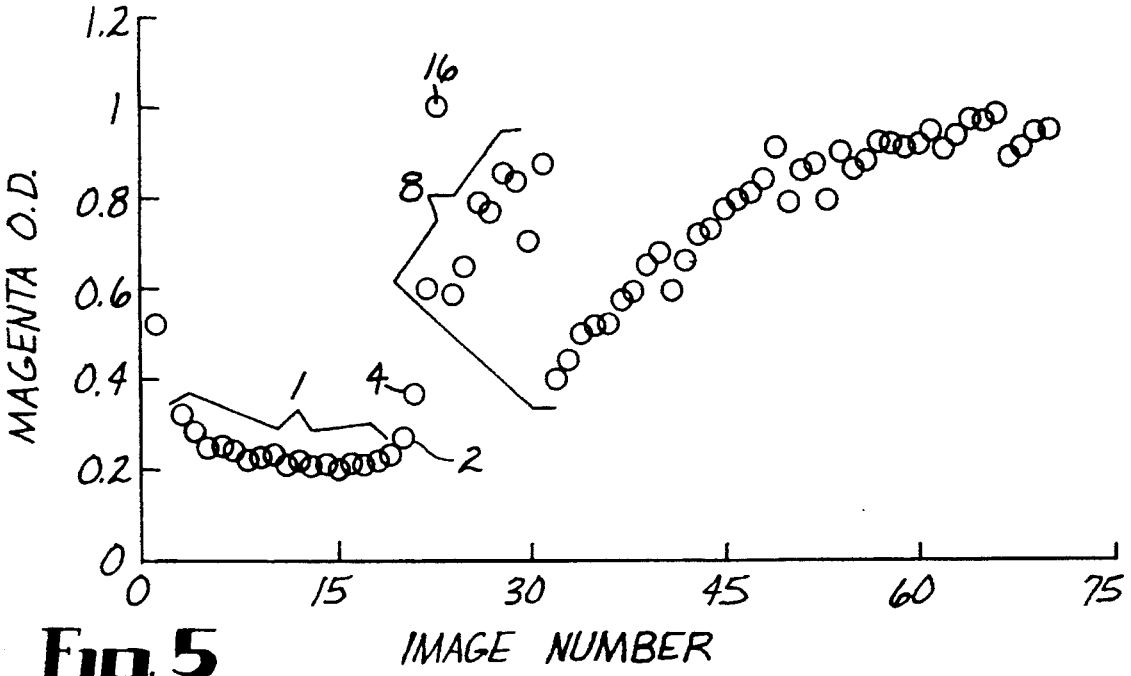
FIG. 5 is a graphical representation of a magenta dye optical density as a function of image number.

A perylene red, long-whisker sample was prepared as described in Example 4. The perylene red whiskers were then vapor coated with manganese (Mn) to a mass equivalent thickness of 100 nm. The metalized whiskers were then encapsulated with the dye/binder and process as described in Example 4. Using a single piece of this nanostructured donor medium, multiple dye transfers to Rainbow TM receiver paper were made using the xenon flash lamp and their optical densities measured with the Gretag densitometer, both previously described. After four preliminary flashes, sixteen single flash images were made first, in quick succession, with approximately 3 seconds between exposures during which the receiver was translated relative to the donor and lamp. Then four images were made using 2,4,8 and 16 flashes respectively, from the same donor medium sample. Finally, forty seven 8-flash images were made, with a pause between the 8th and 9th such images, during which the donor medium cooled. The measured optical densities are shown in FIG. 5 as a function of image number from 1 to 67. As seen, the O.D. remains constant at 0.2 for all the single flashes. The O.D. of the 8-flash images increases with image number due to the warming of the donor from repeated flashings. The O.D. remains high for the 8-flash images even after the 47th such image. The donor is still useful after the equivalent of 425 single flashes.

EXAMPLES 21–24

Examples 21–24 demonstrate the effects of metal coating thickness and whisker length on magenta dye transfer efficiency.

A series of three identically prepared long perylene red whisker samples were made as described in Example 4. These were subsequently coated with varying mass equivalent thicknesses of sputtered Ag, 30 nm of Ag (Example 21), 50 nm of Ag (Example 22), 100 nm of Ag (Example 23). A sample of short perylene red whiskers, prepared as described in Example 1, was vapor-coated with 50 nm mass equivalent of Mn (Example 24), to complete this series.

All four samples were encapsulated with the magenta dye/binder as described in Example 4. Multiple xenon flash image transfers from representative pieces of each donor sample type were made to Rainbow TM receiver and the magenta O.D. was measured, as described in previous examples.

Figure 6:
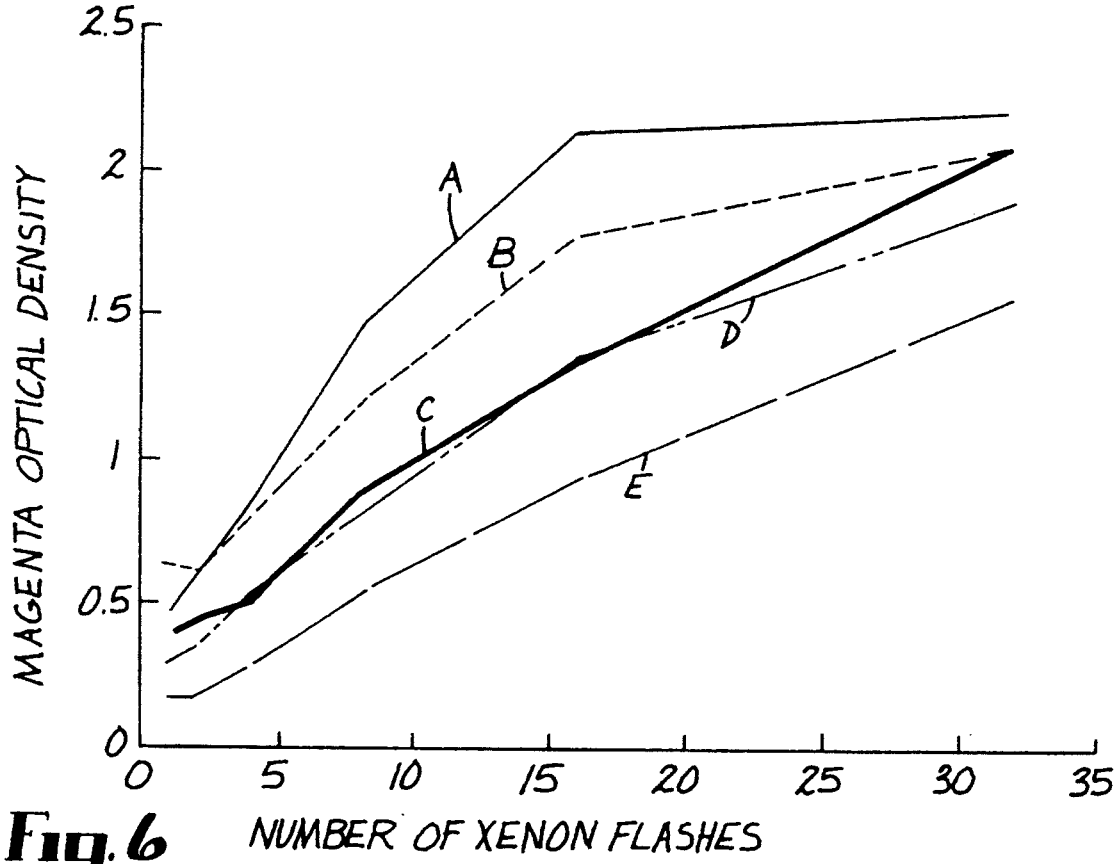
FIG. 6 is a graphical representation of a magenta dye optical density as a function of xenon flashes demonstrating the effect of metal coating thickness and whisker length on magenta transfer efficiency.

FIG. 6 compares these O.D.'s as a function of the number of flashes (exposure) along with those from image numbers 16–23 from Example 20. Curve A shows the results for Example 21, Curve B is Example 22, Curve C is Example 23, Curve D is Example 20, and Curve E is Example 24. The optical density increased approximately proportional to exposure, up to the densitometer measurement limit of O.D. ~2, and that less metal coating appeared to enhance the sensitivity for long whiskers. The results also suggests longer whiskers were better than shorter whiskers for the same actual metal coating thickness per unit whisker length.

EXAMPLE 25

Example 25 shows cyan transfer with multiple flashes and the effect of light absorption by dye in the bulk of the binder.

A long perylene red whisker sample was prepared as described in Example 4 and sputter-coated with 30 nm mass equivalent of Ag. The 8 cm diameter sample disc was encapsulated with a cyan dye/binder by pouring over it 14 ml of a 5% by wt. solution in THF of the following composition: (by weight) 17.8% of heptyl cyan (described in patent applications J61255897 and J60172591), 17.8% octyl cyan (described in patent applications J61255897 and J60172591), 17.8% Foron TM brilliant blue (see Example 2), 35% GEON 178 PVC, 3.1% VITEL PE200D, 5% RD1203 (a fluorocarbon release agent available from 3M) and 3.5% TROYSOL CD-1. It was cured at ambient temperature and the polyimide temporary substrate delaminated by peeling it away from the encapsulated whisker sample. The cyan O.D. was measured for multiple xenon flash image transfers to Rainbow TM receiver paper for two donor media sample pieces of different thicknesses, 1 mil (25 μm) and 2 mil (50 μm).

Figure 7:
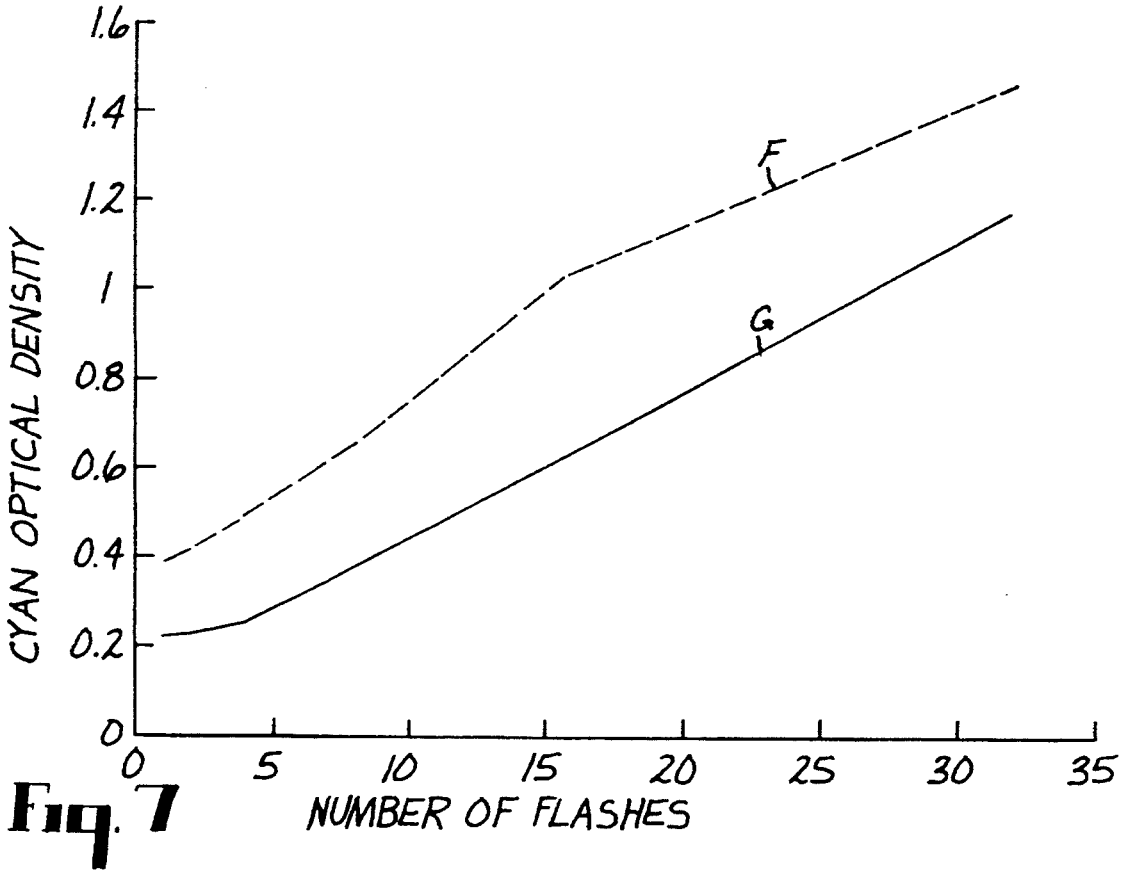
FIG. 7 is a graphical representation of a cyan dye optical density as a function of xenon flashes at two different thicknesses of the donor medium.

The results are shown in FIG. 7 Curve F (25 μm) and Curve G (50 μm), and indicate the cyan dyes transfer was proportional to the exposure. When light was incident from the donor medium side, the absorption by the dye in the bulk of the donor medium limited the light reaching the metal coated whiskers and lowered sensitivity.

EXAMPLE 26

An 8 cm diameter sample of Ag coated perylene red whiskers was prepared as described in Example 25. It was encapsulated by applying 14 ml of a 5% by wt. solution in THF of the following yellow dye/binder: (by weight) 11.9% TPS#2 (described in U.S. Pat. No. 4,988,664), 11.9% 79941-30 (described in U.S. Pat. No. 4,977,134), 23.1% MQ452 (available from Nippon Kayaku), 39.5% GEON 178, 1.98% PE200D and 11.1% TROYSOL CD-1. After drying at ambient temperature, the polyimide temporary substrate was peeled away from the donor medium. A series of single and multiple xenon flash dye transfers to Rainbow TM receiver paper were made using a single piece of this donor medium sample.

Figure 8:
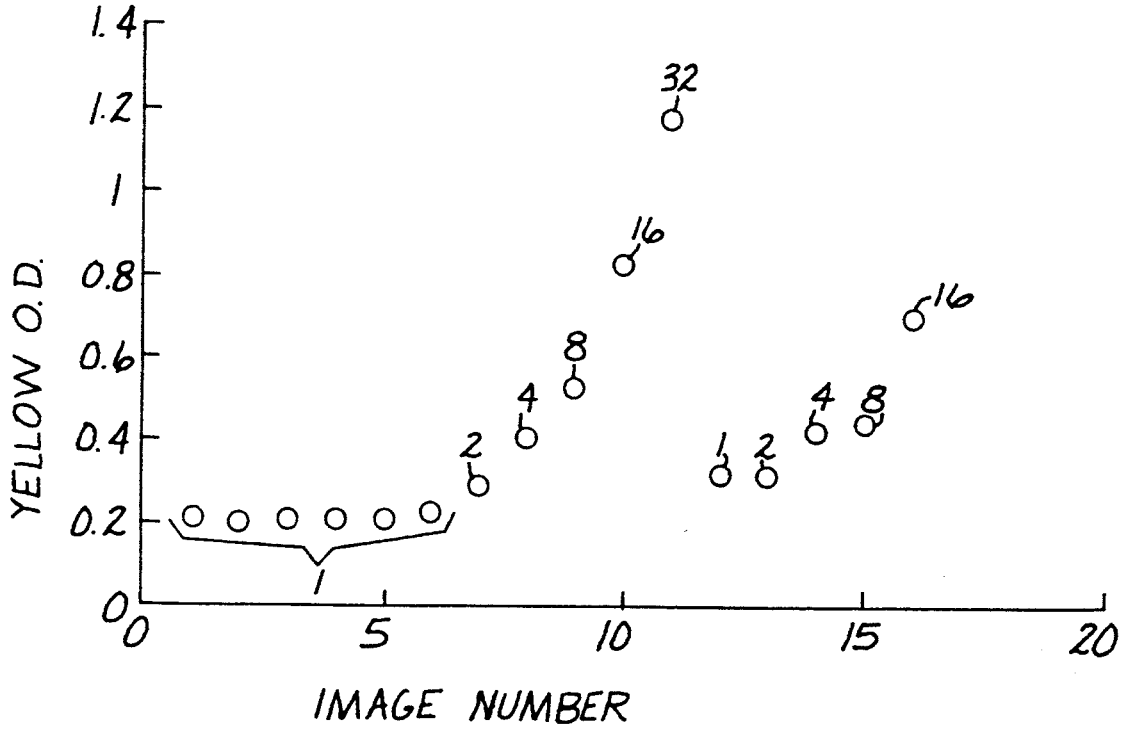
FIG. 8 is a graphical representation of a yellow dye optical density as a function of image number for single and multiple xenon flash transfers.

FIG. 8 shows the measured yellow O.D. measured with the Gretag instrument as a function of the image number. The numbers beside each data point are the number of xenon flashes used to generate the image.

EXAMPLE 27

Example 27 describes transfer to a transparent receiver and shows the enhanced sensitivity when light is not absorbed by the bulk of the donor film.

A donor medium sample piece was used from Example 26. Xenon flash transfer to the transparent receiver sheet described in Example 5, was made with the light incident through the receiver sheet.

Figure 9:
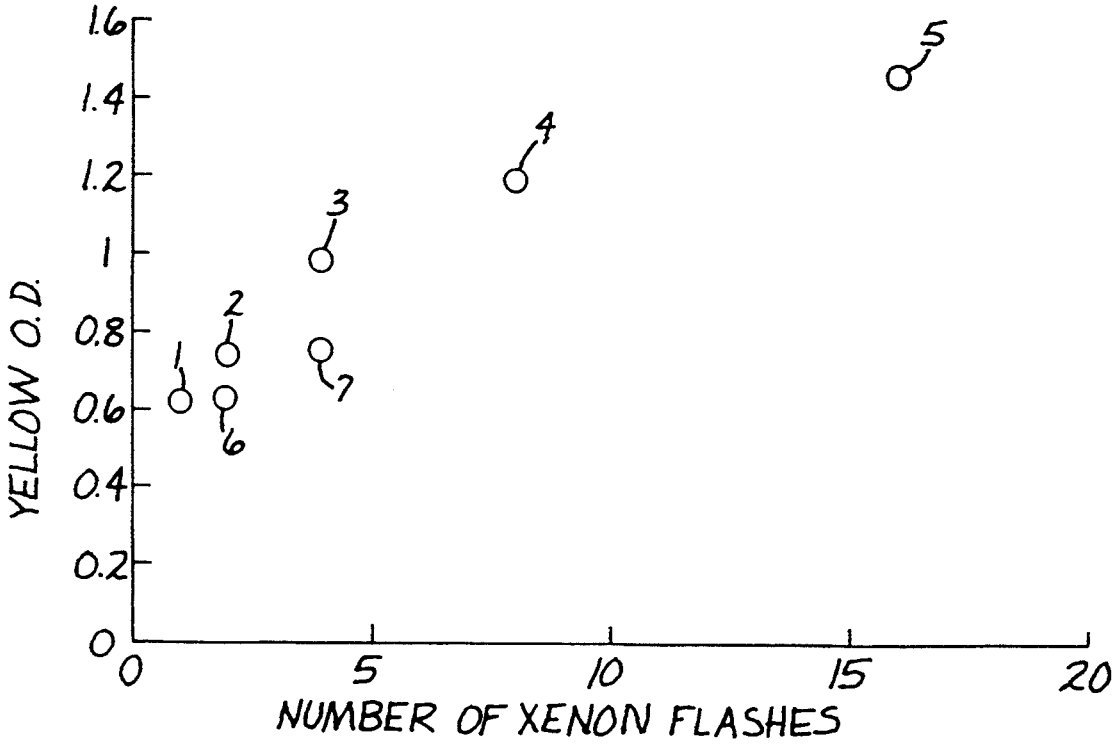
FIG. 9 is a graphical representation of a yellow dye optical density as a function of number of xenon flashes measured when the imaged receptor sheet was lying on white paper.

FIG. 9 shows the yellow O.D. measured with the imaged receiver lying on white paper. The numbers on each data point show the sequential order of the images. Comparing with the results of Example 26 in FIG. 8, it is clear that significantly greater O.D. is achieved with yellow dyes and a xenon flash when light is incident directly on the metal coated whiskers from the receiver side rather than the donor side.

EXAMPLE 28

Example 28 demonstrates dye transfer to plain paper using a focused laser diode and the effect on dot density of the per cent by weight dye dissolved in the PVC binder of the donor.

An ~7 cm×7 cm piece of Ag coated polyimide, having nanostructured whiskers grown on the Ag surface as described in Example 1, was placed on a hot plate and maintained at ~52° C. The whiskers, which previously had been conformally sputter coated with Ag in a similar manner to that described in Example 1, were facing upward. A 3 cm×3 cm inner diameter square glass tube was cut into four 0.5 inch long sections, and the latter placed on the whiskered surface and weighted down to provide four dye solution containment cells. 10% by wt. solutions of Foron TM Brilliant Blue dye (see Example 2) in THF were combined with 10% by wt solutions of polyvinyl chloride (PVC—see Example 4) in THF, to give solutions in THF containing 10% by wt. solids of dye and PVC with weight ratios of dye/PVC of 1/10, 2/10, 3/10, and 4/10. Approximately 1 ml of each of the four solutions were applied with a syringe to each of the four containment cells, and allowed to dry, uncovered for ~90 minutes. After curing, the ~0.019 cm thick, solid dye/PVC films cleanly and completely delaminated from the Ag/polyimide temporary substrate, causing the Ag coated whiskers to be encapsulated in one surface of the dye/PVC film. In a similar fashion, a fifth donor sample was made containing 60% by wt. dye in PVC.

The approximately 1" square donor medium samples were each placed in contact with plain bond paper receiver sheets, with the nanostructured side against the paper, and sandwiched tightly between two glass microscope slides by the pressure of heavy spring clips. The assembly was placed in a diode laser (wavelength ~812 nm) (Spectra Diode Labs. Inc., San Jose, Calif.) scanning facility such that the beam was focused through the donor film onto the plane of the whiskers. The focused beam diameter was ~48 μm and delivered 55 mW to the focal plane. The beam was pulsed 30 pulses/sec, each pulse lasting 300 μsec, giving an energy density of ~1 J/cm$^2$, while the sample was slowly translated 1.87 mm/sec, parallel to its plane, back and forth, in a rastered fashion. The resulting array of cyan dots consisted of lines of dots, the dot centers spaced slightly more than one dot diameter apart (62 μm) along a line, with the lines spaced 0.038 cm apart, giving an image which was ~10% dye image and 90% white paper. The cyan optical densities of the dots from each of the five donor samples were extracted from the measured optical densities of the patterns and white paper background respectively.

Figure 13:
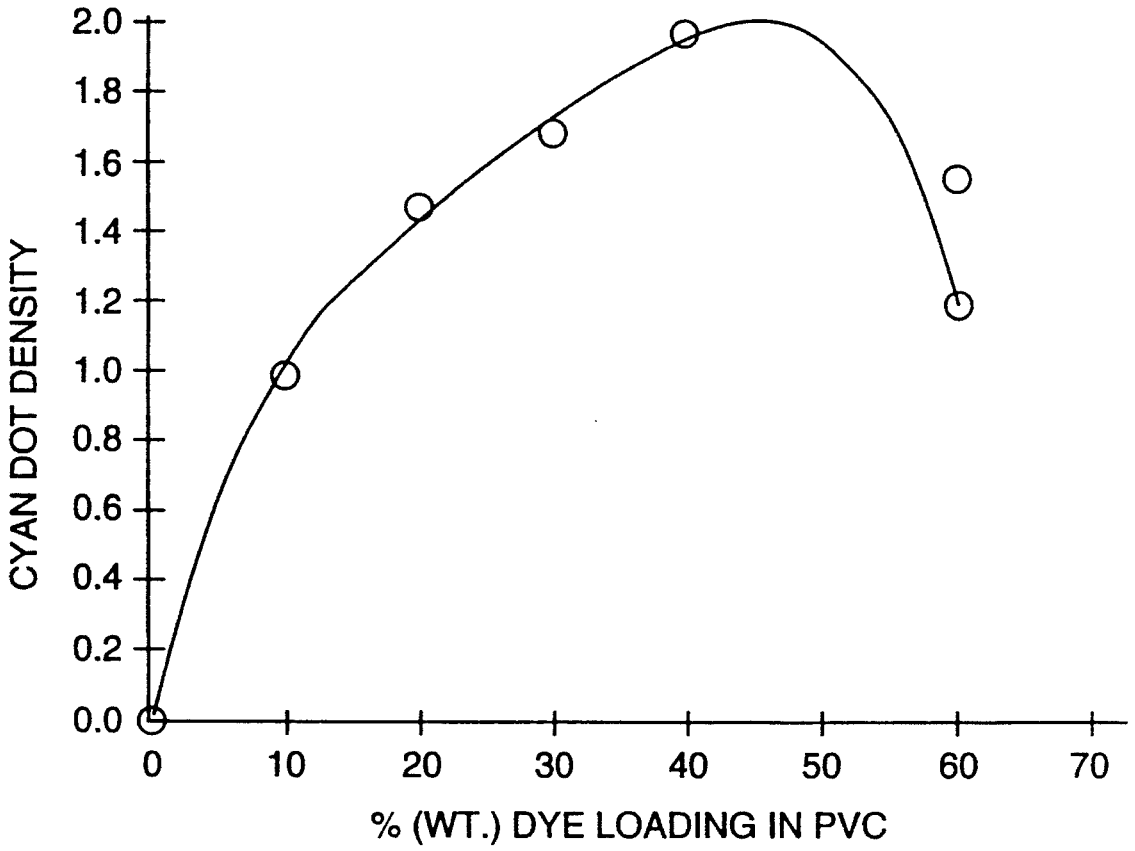
FIG. 13 is a graphical representation of cyan dot density as a function of the % dye loading in PVC.

The open circles in FIG. 13 shows the dot optical density transferred to plain paper as a function of the % by wt. dye loading in the PVC binder, when the donor and receiver were pressed firmly together by spring pressure.

EXAMPLE 29

Example 29 shows enhanced imaging occurred when the nanostructured donor medium and receptor are only lightly pressed into contact.

The 60% by wt. Foron TM Brilliant Blue dye/PVC donor sample from Example 28 was reimaged onto a plain white bond paper receiver in the same manner described in Example 28 except the spring clips were removed and a light pressure of 3.0 gms/cm$^2$ applied to the donor medium/paper sandwich. The resulting dot optical densities are shown as the filled circle data point in FIG. 13, showing that enhanced dye transfer is obtained with lower pressure. The image was also seen to have fewer defects or dot imperfections than the comparative high pressure example in Example 28. Both the more efficient dye transfer and lower defects are understood to be the result of reduced cooling of the donor medium by the receptor when the extent of physical contact is reduced. The reduced cooling allows the donor medium to reach a higher temperature during the laser pulse and thereby facilitate the volatilization of the dye and enhance the dye transfer.

EXAMPLES 30 AND 31

Examples 30 and 31 demonstrate that effective dye transfer occurs with a physical space between the donor and receiver in air.

EXAMPLE 30

A magenta dye/PVC donor film was formed with Ag coated whiskers prepared as in Example 28. The magenta dye is a member of the class described in Japanese Patent Application J0 2084-390-A,

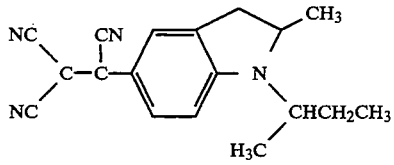

and was dissolved in a THF/PVC solution to give a 33% by wt. dried ratio of dye to PVC. 1.5 ml of the solution was poured over the whisker coated polyimide, held by the glass containment cell on the hot plate, as described in Example 28, and allowed to dry for ~2 hours. After delaminating the nanostructured donor film from the Ag coated polyimide temporary substrate by peeling, imaging to plain bond paper was demonstrated with the same conditions and laser scanner as described in Example 28. The magenta dot array images showed magenta optical densities, for example, of approximately 1.2 with 50 mW, 100 μsec pulses. The dot array pattern showed numerous defects and dropouts associated with variations in the degree of intimate contact between the donor medium and receptor. A 40.6 μm thick sheet of polyethylene was placed between the donor medium and paper receiver having a 0.63 cm×2.54 cm center rectangle removed and the sandwich construction reimaged as first described. The volatilized dye passed through the rectangular opening and deposited in the same dot array pattern onto the paper. The magenta optical density of the dots was still found to be 1.2, although they were broadened due in part to scattering of the dye molecules by the intervening air. More importantly, however, the dropouts and defects were either no longer present, or much reduced in the image made with the spacer layer.

EXAMPLE 31

The 40% by wt. Foron TM Brilliant Blue/PVC donor sample as described in Example 28 was placed over a piece of plain bond paper with a 25.4 μm thick woven wire mesh used as a spacer between the donor and receiver. The woven mesh had a transparency factor of 95% (purchased from Metal Textile Corp., Roselle, N.J.). With the same pressure applied by the spring clips to glass slides as described in Example 28, a cyan dot array pattern was formed on the paper by scanning as in the previous examples, with 55 mW and 300 μsec pulse time. The wire mesh kept the donor spaced 25.4 μm away from the paper receiver. The masking effect of the 25.4 μm thick wires could be seen in the image, and the dots appeared well formed in some areas of the image, indicating resolution was preserved in those areas despite the 25.4 μm gap. The extracted dot optical density was within 15% of the dot density obtained without the spacer, however, as in Example 29 and 30, the image defects and artifacts, seen when the donor medium and receptor paper were held in close physical contact, were eliminated when the spacer was used.

EXAMPLE 32

Example 32 demonstrates multiple dot transfers from the same spot on the donor with laser diode excitation.

A magenta nanostructured donor film was prepared as described in Example 30, but having a 60% dye/PVC weight ratio and the same Ag coated whiskers as described therein. The donor film was fixed relative to the laser beam while a 2.54 cm wide strip of Rainbow TM receiver, previously described, was held against the donor with mild pressure and translated parallel to the strip's length at 1.9 mm/sec relative to the donor. During the translation, the laser diode, also previously described, was pulsed 3 times per second so that a string of dye transferred dots was formed on the receiver. The number of dots transferred, before their optical density significantly decreased, was observed to depend directly on the pulse length. For example, 72 mW pulses, 1455 μsec long produced over 20 dots of roughly equal optical density, 1000 μsec pulses produced about 25 dots of slightly lower average optical density, 500 μsec pulses produced about 40 dots of distinctly lower optical density, and similarly, 250 and 125 μsec pulses each produced correspondingly more dots, but of lower optical density, consistent with the nanostructured donor film's capability as a multiple use continuous tone donor medium.

EXAMPLE 33

Example 33 illustrates the process for preparing a dye containing pre-donor sheet and then embedding the nanostructured elements into this pre-donor sheet via hot roll calendering.

75.0 wt % polyvinyl chloride (PVC) homopolymer #355 (available from Scientific Polymer Products Inc., Ontario, N.Y.) was compounded with 25.0 wt % Keyplast TM Blue "A" dye (available from Keystone Aniline Corp., Chicago, Ill.) using a Brabender Plasticorder type EPL3302 with a Direct Current Drive type SABINA (available from C. W. Brabender Instruments Inc., South Hackensack, N.J.) and a Rheomix model 5000 mixing chamber with high shear blades (available from Haake Inc., Saddle Brook, N.J.). Using a ratio of 3 parts heat stabilizer (T-634, available from Ciba-Geigy, Additives Div., Hawthorne, N.Y.) to 100 parts PVC, the heat stablizer was slowly added dropwise by syringe through the top of the chamber as the PVC powder was mixed at low speed. The chamber heaters were turned on and allowed to heat at a rate of 4 Kelvin/minute (K./min.). The dye was added at a chamber temperature of 453 K. Mixing was continued at a constant temperature of 453 K. for 10 min. then the heating was stopped and the blend removed. The hot plastic blend was run through a room temperature two roll mill to form a rough sheet.

The rough sheet of compounded material was then sandwiched between two pieces of Upilex "S" brand 51 μm thick polyimide film (Distributed by ICI Films, Wilmington, Del. and manufactured by UBE Industries LTD, Tokyo, Japan) and placed between preheated (414 K.) 6" square platens on a model "C" Carver Laboratory Press (available from Fred S. Carver Inc., Menomonee Falls, Wis.). The total force exerted on the hot platens was slowly increased to $7\times10^4$N (8 tons) (from the hydraulic press gauge) in 3 continuously increasing steps of $2.7\times10^4$N, $5.3\times10^4$N and $7\times10^4$N, each held for 10 min, to produce a defect free 127 mm thick, 6"×6" pre-donor medium of PVC/dye.

The nanostructure elements on a temporary substrate were prepared as described in Example 1. A 1 cm×3 cm sheet of metal coated perylene red whiskers, grown on a Cu-coated 51 μm thick polyimide temporary substrate, was placed whisker side down against a 1 cm×3 cm piece cut from the 127 mm pre-donor medium sheet of PVC/dye blend and then sandwiched between two pieces of 51 μm thick Upilex "S" polyimide film. This was then placed between preheated platens (422 K.) on the model "C" Carver press and a load of $1.78\times10^8$ Pa ($2.6\times10^4$ psi) was applied for 5 sec. The sample was removed and allowed to cool. The polyimide temporary substrate was peeled from the active surface leaving the whiskers hot pressed into the surface of the pre-donor medium. The embedding process reduced the total thickness to 0.076 mm.

The scanning electron micrograph of FIG. 12 shows the pressed whiskers were located in the upper 2 μm of the composite film and remained oriented normal to the surface without any damage to the nanostructured elements.

Figure 11:
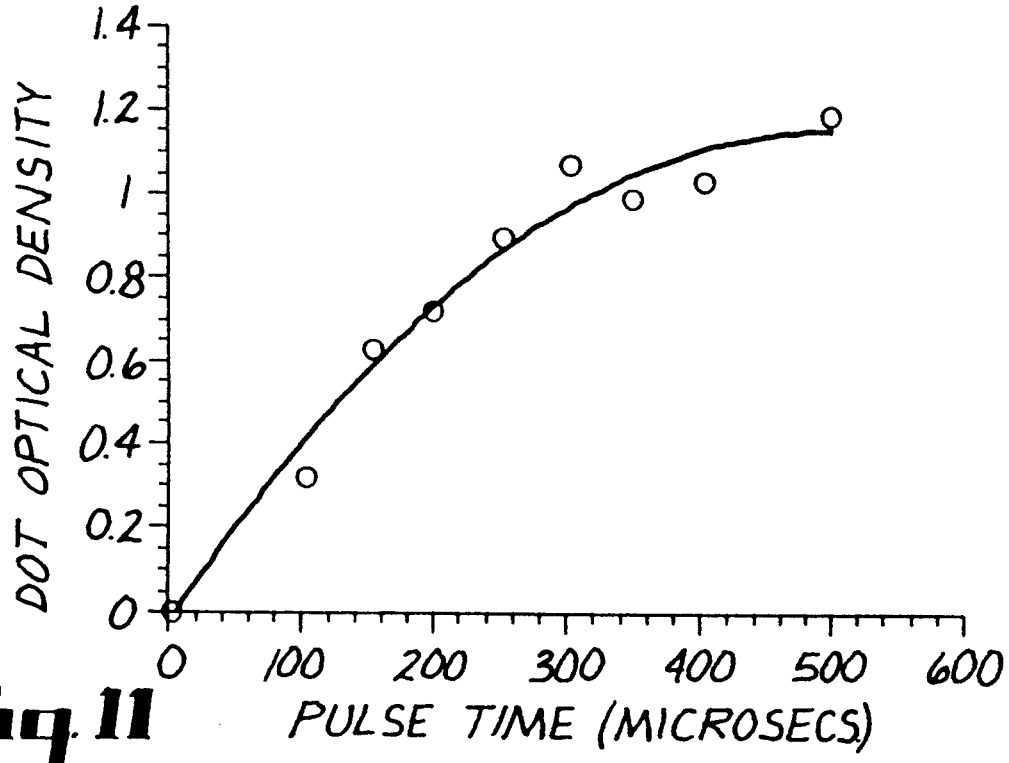
FIG. 11 is a graphical representation of the cyan optical density on bond paper as a function of laser pulse length.

The donor medium sample was placed with the nanostructured element (active surface) side against a piece of white bond paper, and the pair were sandwiched between two microscope slides for mounting on a low power laser scanner (812 nm), providing a 55 mW beam focused at the donor/receptor interface to ~48 μm in diameter. Using 400 μsec long pulses and 15 pulses/sec, the sample assembly was scanned back and forth at 1.87 mm/sec perpendicular to the beam in a rastered fashion, producing a pattern of lines spaced 0.38 mm apart, each line consisting of ~50 μm diameter cyan colored dots spaced ~62 μm apart, on the white paper. The dots were seen to be well formed under a microscope. This procedure was repeated on new pieces of receiver paper for laser pulse times of 100, 150, 200, 250, 300, 350, 400 and 500 μsec. The average optical densities of the dots in each image were measured and are shown in FIG. 11 as a function of pulse time.

EXAMPLES 34–38

In Examples 34–38, the pressure and temperature of the platens used for encapsulation (that is, embedding the elements) of the nanostructure elements into the pre-donor sheet was varied. The films of nanostructure elements used were taken from the same larger sample piece. The laser dye transfer optical densities suggests there are preferred temperature and pressure ranges.

EXAMPLE 34

75.0 wt % #355 PVC homo polymer was dry blended with 25.0 wt % Keyplast TM Blue "A" dye and heat stablizer Organostab TM T-634 in a Model 1120 Waring blender (available from Waring Products Div., New Hartford, Conn.). Using a ratio of 3 parts to 100 parts PVC, the heat stablizer was added dropwise by syringe through the top cover as the PVC powder mixed at low speed. The mixing was stopped and the dye was added. The mixing was resumed at high speed for 20 minutes to obtain uniformity. A 200 gram batch of this dry PVC/dye mixture was produced.

25 cc of this mixture was compounded using a Brabender Plasticorder type EPL3302 with a Direct Current Drive type SABINA and a Rheomix model 620 mixing chamber (available from Haake Inc., Saddle Brook, N.J.). The mixing chamber was allowed to heat to 403 K. with the mixing blades rotating before the PVC/dye blend was added to the chamber. The temperature was slowly increased at a rate of 2 K./min to 456 K. and mixed for 20 min. After the mixing was completed the hot plastic was removed and run through a room temperature steel two roll nip to form a rough sheet.

The compounded material was then sandwiched between two sheets of 51 μm thick Upilex "S" polyimide film and hot pressed into a defect free 127 μm thick pre-donor medium sheet using the same conditions stated in Example 33.

A 0.8 cm×5 cm piece of metal coated whiskers on a Cu-coated 51 μm thick polyimide substrate was placed nanostructure side down against a slightly larger piece cut from the 127 μm pre-donor sheet of PVC/dye blend and then sandwiched between two pieces of Upilex "S" film. This was then placed between preheated platens (438 K.) on the model "C" Carver press and a load of $6.67\times10^7$ Pa (9677 psi) was applied for 10 sec. The sample was removed and allowed to cool. The polyimide substrate for the whiskers was peeled from the surface leaving the whiskers hot pressed in the surface of the pre-donor. The embedding process reduced the total thickness to 0.076 mm.

A dot pattern image was produced on bond paper with the low power laser scanner in the same manner described in Example 33 using 500 μsec pulses. The cyan dot O.D. was measured to be 1.19.

EXAMPLE 35

The compounding and pre-donor processing and materials are the same as used in Example 34. A 1 cm×3 cm piece of Ag-coated whiskers was placed whisker-side down on the pre-donor and prepared for hot pressing as described in Example 34. This was placed between preheated platens (450 K.) and a load of $2.96\times10^7$ Pa (4300 psi) was applied for 10 sec. The sample was removed and allowed to cool. The polyimide substrate for the whiskers was peeled from the surface leaving the whiskers hot pressed in the surface.

A dot pattern image was produced on bond paper with the low power laser scanner in the same manner described in Example 33 using 500 μsec pulses. The cyan dot O.D. was measured to be 0.77.

EXAMPLE 36

A 0.8 cm×5.2 cm piece of metal coated whiskers was placed whisker side down on the pre-donor and prepared for hot pressing as described in Example 34. This was placed between preheated platens (438 K.) and a load of $2.1\times10^7$ Pa (3100 psi) was applied for 10 sec. The sample was removed and allowed to cool. The polyimide substrate for the whiskers was peeled from the surface leaving the whiskers hot pressed in the surface.

A dot pattern image was produced on bond paper with the low power laser scanner in the same manner described in Example 34 using 500 μsec pulses. The cyan dot O.D. was measured to be 1.02.

EXAMPLE 37

A 0.8 cm×5.2 cm piece of metal coated whiskers was placed whisker side down on the pre-donor and prepared for hot pressing as described in Example 34. This was placed between preheated platens (438 K.) and a load of $10.7\times10^7$ Pa (15,500 psi) was applied for 10 sec. The sample was removed and allowed to cool. The polyimide substrate for the whiskers was peeled from the surface leaving the whiskers hot pressed in the surface.

A dot pattern image was produced on bond paper with the low power laser scanner in the same manner as described in Example 34 using 500 μsec pulses. The cyan dot O.D. was measured to be 0.84.

EXAMPLE 38

A 0.7 cm×5.0 cm piece of Ag-coated whiskers was placed whisker side down on the pre-donor and prepared for hot pressing as described in Example 34. This was placed between preheated platens (355 K-top platen and 311 K-bottom platen) and a load of $3.8\times10^7$ Pa (5,530 psi) applied for 5 sec. The sample was removed and allowed to cool. The polyimide substrate for the whiskers peeled from the surface leaving the whiskers hot pressed in the surface.

A dot pattern image was produced on bond paper with the low power laser scanner in the same manner described in Example 33 using 500 μsec pulses. The cyan dot O.D. was measured to be 0.43.

EXAMPLES 39–41

Examples 39–41 compare the effects of the amount of plasticizer used in the PVC, and show that the softness of the donor medium affects the degree of laser induced damage or conditioning done to the nanostructured surface.

EXAMPLE 39

An 8.9 cm×10.2 cm piece of Ag-coated whiskers was placed whisker side down on the pre-donor and prepared for hot pressing as described in Example 34. This was placed between preheated platens (416 K.) and a load of $4.9\times10^6$ Pa (715 psi) applied for 20 sec. The sample was removed and allowed to cool. The polyimide substrate for the whiskers was peeled from the surface leaving the whiskers hot pressed in the surface of a "rigid" donor sheet.

The donor sheet was placed with the nanostructured side against a slightly smaller sheet of paper, and imaged with a high power laser diode scanner delivering on the order of a few Joules/cm$^2$ in ~1 msec to a spot approximately 150 μm×50 μm in size. A small vacuum source applied to the back of the paper held the donor and receiver paper together. The sample assembly was translated under a modulated laser scanner to produce an ~4 cm×6 cm rectangular cyan image of high resolution text and geometric patterns. Four separate images were produced on both ordinary bond and clay coated papers. The maximum cyan O.D., measured at the same reference position on each of images 1, 2 and 4 were 0.44, 0.82, and 0.81, respectively. SEM characterization of the imaged donor surface showed that where high power laser pulse had irradiated the surface in 150 μm×50 μm spots, the initially smooth surface had been transformed into a dense distribution of "micro-volcanoes", or closely packed conical shaped features protruding a few microns from the surface, each on the order of 3–5 μm in diameter. A central hole, ~1 μm was at the center of each microconical feature. The nanostructure elements could be seen within the walls of the cone like features.

EXAMPLE 40

13.5 grams of #3300R 80NT CL BLU 213 PVC pellets (available from Teknor Apex, Pawtucket, R.I.) were compounded with 16.75 grams of the dry blend (Example 34) on a Brabender Plasticorder type EPL3302 with a Rheomix Model #620 mixing chamber to give a 50:50 (approximate) ratio of rigid PVC to plasticized PVC with 13.8 wt % dye, 44.6 wt % #3300R 80NT CL BLU 213 PVC pellets and 41.6 wt % #355 PVC homopolymer. With the mixing blades turning slowly (20 rpm) the chamber was heated to 403 K. The dry blend and pellets were then added and heating was continued to a temperature of 453 K. The temperature was held constant (453 K.) for 20 minutes while the molten plastic and dye mixed. The hot dye/PVC blend was then removed from the chamber and run through a room temperature two roll mill to form a rough sheet.

The rough sheet was then sandwiched between two pieces of Upilex "S" brand 51 μm thick polyimide film and placed between preheated (411 K.) 6" platens on a model "C" Carver Laboratory Press. The total force exerted on the hot platens was slowly increased to $8\times10^4$N in a continuous motion and held for 30 minutes to produce a defect free 127 μm thick 6"×6" pre-donor sheet of PVC/dye blend.

A 11.5×8.9 cm sheet of Ag coated whiskers, prepared as in Example 33, was placed whisker side down against a slightly larger sheet of the pre-donor and then sandwiched between two pieces of Upilex "S" 51 μm thick polyimide film. This was then placed between preheated platens (427 K.) on the model "C" Carver press and a load of $3.45\times10^6$ Pa (508 psi) applied for 15 sec. The sample was removed and allowed to cool. The polyimide substrate for the whiskers was peeled from the surface leaving the whiskers hot pressed in the surface of the pre-donor.

Two separate images were produced on bond and clay coated paper using the laser scanner described in Example 39. SEM characterization of the donor surface in the imaged area indicated it had been severely disrupted by the laser because the polymer binder was too soft for this laser energy.

EXAMPLE 41

4.5 grams of #3300R 80NT CL BLU 213 PVC pellets and 3.0 grams of Keyplast TM Blue "A" dye were compounded with 26.1 grams of the dry blend (Example 34) on a Brabender Plasticorder type EPL3302 with a Rheomix Model #620 mixing chamber to give a 80:20 (approximate) ratio of rigid PVC to plasticized PVC with 28.3 (wt) % dye, 58.3 (wt) % #355 PVC homopolymer and 13.4 (wt) % #3300R 80NT CL BLU 213 PVC pellets. With the mixing blades turning slowly (20 rpm) the chamber was heated to 403 K. The dry blend and pellets were then added and heating was continued to a temperature of 433 K. where the additional 3.0 grams of dye was added. Heating was continued to a temperature of 453 K. and held constant for 20 minutes while the molten plastic and dye mixed. The hot dye/PVC blend was then removed from the chamber and run through a room temperature two roll mill to form a rough sheet.

The rough sheet was sandwiched between two pieces of Upilex "S" brand polyimide film and placed between preheated (422 K.) 6" platens on a model "C" Carver Laboratory Press. The total force exerted on the hot platens was slowly increased to $8\times10^4$N in a continuous motion and held for 30 minutes to produce a defect free 127 μm thick 6"×6" pre-donor sheet of the PVC/dye blend.

A 9.9 cm×8.3 cm piece of Ag coated whiskers as described in Example 33 was placed whisker side down on the pre-donor and prepared for hot pressing as per Example 34. This was placed between preheated platens (422 K.) and a load of $5.41\times10^6$ Pa (785 psi) applied for 5 sec. The sample was removed and allowed to cool. The polyimide substrate for the nanostructured elements was peeled from the surface leaving the nanostructured elements hot pressed in the surface.

The donor sample was imaged in the same manner as described Examples 39 and 40. SEM characterization of the surface in the imaged areas showed a minimal effect of the laser on the donor surface compared to either Examples 39 or 40. The surface appeared to consist of very many submicroscopic pores, possibly created by the escaping dye vapor during imaging. The plasticized 80:20 blend is preferred over the nonplasticized PVC of Example 39 or the 50:50 blend of Example 40.

EXAMPLE 42

An 80:20 ratio PVC pre-donor material was prepared as per Example 41. The pre-donor was further processed by calendering on a heated two roll laminator. A 0.0173 cm thick strip of fiberglass tape was wrapped around the outer edges of the bottom roll to act as a shim during calendering. Several 6"×6" pre-donor sheets put end to end with a 1" overlap were sandwiched between a top and bottom web of 51 μm thick Upilex "S" polyimide film. The web and pre-donor material were preheated with a hand held heat gun before entering the nip between the steel rolls. The two steel rolls were heated to a temperature of 433 K. Using a web speed of 0.91 meters/min., and a nip force of 1.28 N/m, and keeping constant hand tension on the web, the pre-donor was transported through the nip to form a smooth continuous 100–125 μm thick single 8"×16" sheet of pre-donor material.

A 1 cm×2 cm piece of nanostructured elements was placed whisker side down on a 2 cm×5 cm piece of the calendered pre-donor material and sandwiched between two sheets of polyimide film. The top roll of the two roll calendering unit was changed to a 70 durometer silicon rubber coated steel roll for the hot roll embedding process. The rolls were preheated to 433 K. (the silicon coated roll was typically 17 K. cooler than the steel bottom roll) and a nip force of 0.73 N/m was applied. Before the pre-donor and nanostructured elements were transported through the nip they were preheated for several seconds through web contact with the bottom roll. After moving through the nip the sample was allowed to cool. The polyimide substrate for the nanostructured elements was the peeled from the surface leaving the nanostructured elements hot roll pressed into the surface. SEM micrographs show the nanostructured elements are fully embedded into the pre-donor medium and have retained an orientation normal to the surface.

EXAMPLE 43

Example 43 shows that a physical space between the donor and receiver increases the amount of dye transfer without loss of resolution, as a result of laser induced surface conditioning.

The donor sample used for Example 39 was imaged as described in Example 39 but with the donor sheet and paper receiver spaced apart 25 μm by a loosely (95% transparency) woven stocking mesh made with 25.4 μm diameter wires. Two cyan images made with this spacer had higher optical densities than the previous four made with the donor and receiver sheet in close physical contact. The O.D. of the 5th and 6th images at the same position on the images as measured for images 1–4, were 1.13 and 1.25, respectively. Furthermore, with magnification it could be seen that the dye transferred to the paper receiver remained in the shape of a 150 μm by 50 μm spot, despite the 25 μm spacing, and the woven mesh wires cast sharp shadows on the image. Both observations imply the dye was transported in a collimated stream to the receiver, perhaps collimated by the cone-like features discussed in Example 39.

EXAMPLES 44–45

Examples 44 and 45 demonstrate the encapsulation of nanostructure elements in a 100% dye layer to form a multiple use donor element.

EXAMPLE 44

A solid Cu plate was placed on a hot plate and heated sufficient to melt a pool of Foron TM Brilliant Blue (FBB) dye placed on its surface. While the pool was molten, an ~1.9 cm×2.5 cm piece of the Ag-coated nanostructure elements as described in Example 28 was placed on top of the pool, whisker side down, allowing the dye to wick into the nanostructure layer. The Cu plate was allowed to cool and after the dye solidified, the initial polyimide substrate of the nanostructure elements was peeled away leaving the nanostructure elements encapsulated in the 100% dye layer on the Cu plate, forming the donor medium.

A piece of 25 μm thick PVC film (Scotchcal TM film, available from 3M Co., St. Paul, Minn.) was placed on the donor medium as a dye receiver, and rubbed by hand to make intimate contact. Using the laser diode facility described in Example 28, with a power 50 mW focussed to ~50 μm and pulse times of 25, 50, 100 and 200 μsec, sharp cyan dots were produced on the Scotchcal TM film at all conditions.

EXAMPLE 45

A 2.5 cm×1.2 cm sized piece of the Ag-coated nanostructure elements as described in Example 28 was placed nanostructure side up on a glass microscope slide. Approximately 10 mg of FBB cyan dye was placed on the nanostructured elements and heated on a hot plate to cause the dye to melt. Small pieces of 25 μm thick polyester was placed on the ends of the glass slide to act as spacer supports for a second glass slide laid over the molten dye and supported on its ends by the PET pieces. Upon cooling, the polyimide temporary substrate initially supporting the nanostructure elements was peeled away to leave a 25 μm thick layer of FBB dye attached to the top glass slide with nanostructure elements encapsulated at the air/dye surface.

Using white bond paper as the dye receiver, the paper was held in contact with the nanostructured surface of the donor medium and imaged with the laser scanner described above. The laser was incident through the glass slide supporting the donor film. Sharp, ~50 μm diameter dots were formed on the paper with the ~50 mW laser power at pulse times as short as 28 μsec. Pulse times of 50, 75, 100, 150 and 200 μsec pulses produced increasingly higher optical density images.

EXAMPLES 46–48

Examples 46–48 demonstrate a construction of the donor medium in which the nanostructure elements are first encapsulated in a binder with 0% dye concentration initially, and then placed in contact with a 100% dye layer.

EXAMPLE 46

A 1 cm×0.5 cm sized piece of the Ag-coated nanostructure elements as described in Example 28 was coated with a thin layer of PVC by dipping the strip into a 3 wt % solution of PVC in THF, allowing the excess solution to drain off, and then air dry. The dipping and drying was repeated twice. The metal coated whiskers, with the thin layer of encapsulating PVC, was placed onto a molten pool of FBB dye on a glass slide, followed by cooling of the slide to solidify the dye. After cooling the initial polyimide substrate supporting the nanostructure elements was delaminated to leave the PVC encapsulated whiskers attached to the dye layer, on the glass slide. This donor medium was placed in contact with white bond paper and imaged as described in Example 45, with 100 μsec pulses and 60 mW peak power at the imaging plane. Good dot images were produced.

EXAMPLES 47–48

Donor medium were prepared and imaged as described in Example 46, but using 5 wt % and 2 wt % concentrations of PVC/THF solutions, respectively.

Various modifications and alterations of this invention will become apparent to those skilled in the an without departing from the scope and spirit of this invention, and it should be understood that this invention is not to be unduly limited to the illustrative embodiments set forth herein above.

We claim:

1. A reusable composite donor medium comprising a nanostructured surface region and an encapsulant containing image forming material such that the nanostructured surface region is at at least one major surface of the medium and the nanostructured surface region absorbs radiation and converts the radiation to heat to thermally transfer the image forming material to a receptor positioned near or adjacent to the medium and the nanostructured surface region has sufficient capillarity to replenish image forming material into the nanostructured surface region between imaging events, and wherein the nanostructured surface region has a spatial inhomogeneity in two dimensions and is comprised of elongated radiation absorbing particles encapsulated exactly at the surface of the encapsulant with sufficient numbers per unit area to achieve efficient light absorption and high capillarity.

2. The reusable composite donor medium according to claim 1, wherein the nanostructured surface region is comprised of nanostructured elements either uniaxially oriented or randomly oriented, such that at least one point of each nanostructured element contacts a two-dimensional surface common to all of the nanostructured elements.

3. The reusable composite donor medium according to claim 1, wherein the nanostructured surface region is comprised of two-component nanostructured elements having an areal number density in the range of 40–50/$\mu m^2$ wherein the first component is an oriented, sub-microscopic whisker having a high aspect ratio and the second component is a radiation absorbing conformal coating material.

4. The reusable composite donor medium according to claim 1, wherein the nanostructured surface region is comprised of single-component nanostructured elements having an areal number density in the range of 40–50/$\mu m^2$ wherein the component is an oriented, sub-microscopic whisker having a high aspect ratio and is a radiation absorbing material.

5. The reuseable composite donor medium according to claim 1, wherein the encapsulant contains up to 100% by weight of an image forming material and the balance of the layer to equal 100% by weight is a film forming binder.

6. The reusable composite donor medium according to claim 5, wherein the encapsulant is 100% by weight of a film forming binder and the donor medium further comprises a layer of image forming material in contact with the surface of the medium on the surface opposite the surface containing the nanostructured surface region.

7. The reusable composite donor medium according to claim 6, wherein the layer of image forming material is comprised of up to 100% by weight of the image forming material and the balance of the layer to equal 100% by weight is a film forming material.

8. The reusable composite donor medium according to claim 7, wherein the layer of image forming material is 100% by weight of image forming material and the donor medium further comprises a transparent substrate laminated to the surface of the layer of image forming material on the surface opposite the surface containing the nanostructured surface region.

9. The reusable composite donor medium according to 5, wherein the image forming material is a thermally transferable dye, leuco dye, sensitizer, crosslinker, or surfactants.

10. The reusable composite donor medium according to claim 9, wherein the image forming material is a thermally transferable dye.

11. A nanostructured imaging transfer element comprising, in sequential order:

(a) a plurality of nanostructured elements embedded into a thin film of a porous or permeable polymer;
(b) an encapsulant;
(c) an image forming material reservoir layer comprising:
  (i) up to 100% by weight of an image forming material; and
  (ii) sufficient film forming binder such that % by weight of the image forming material and film forming binder is equal to 100% by weight; and
(d) a transparent substrate.

12. The nanostructured imaging transfer element according to claim 11, wherein the nanostructured elements are two-component elements having an areal number density in the range of 40–50/$\mu m^2$ wherein the first component is an oriented, sub-microscopic whisker having a high aspect ratio and the second component is a radiation absorbing conformal coating material.

13. The nanostructured imaging transfer element according to claim 11, wherein the nanostructured elements are single-component elements having an areal number density in the range of 40–50/$\mu m^2$ wherein the component is an oriented, sub-microscopic whisker having a high aspect ratio and is a radiation absorbing conformal coating material.

14. The nanostructured imaging transfer element according to claim 11, wherein the encapsulant is a porous or permeable polymer.

15. The nanostructured imaging transfer element according to claim 11, wherein the image forming material containing reservoir contains 100% by weight of the image forming material.

16. A process for preparing a reusable nanostructured composite film comprising the steps:

(a) preparing nanostructured elements on a temporary substrate;

(b) preparing a web of 0–100% by weight of image forming material and 100–0% by weight of a polymeric binder; and (c) introducing the nanostructured elements and the web of image forming material and the polymeric binder to a two roll mill, wherein the temporary substrate is removed while the nanostructured elements are hot roll calendered into the web of image forming material and polymeric binder.

17. The process according to claim 16, wherein the nanostructured elements are two-component elements having an areal number density in the range of 40–50/$\mu m^2$ wherein the first component is an oriented, sub-microscopic whisker having a high aspect ratio and the second component is a radiation absorbing conformal coating material.

18. The process according to claim 16, wherein the nanostructured elements are single-component elements having an areal number density in the range of 40–50/$\mu m^2$ wherein the component is an oriented, sub-microscopic whisker having a high aspect ratio and is a radiation absorbing conformal coating material.

19. The process according to claim 16, wherein the web is 100% image forming material.

20. The process according to claim 19, wherein the image forming material is a thermally transferable dye.

* * * * *

UNITED STATES PATENT AND TRADEMARK OFFICE

CERTIFICATE OF CORRECTION

PATENT NO. : 5,352,651

DATED : October 4, 1994

INVENTOR(S) : Debe et al.

It is certified that error appears in the above-indentified patent and that said Letters Patent is hereby corrected as shown below:

On the title page, item [75], Replace "Md" with --Minn--

Col. 11, line 50, Replace "U" with --Å--

Col. 31, line 28, Replace "an" with --art--

Signed and Sealed this

Second Day of May, 1995

Bruce Lehman

*Attest:*

BRUCE LEHMAN

*Attesting Officer*

*Commissioner of Patents and Trademarks*